US012624875B2

(12) United States Patent
Costanza et al.

(10) Patent No.: US 12,624,875 B2
(45) Date of Patent: May 12, 2026

(54) OPEN-WALLED, TEMPERATURE CONTROLLED ENVIRONMENT

(71) Applicant: KPS GLOBAL LLC, Fort Worth, TX (US)

(72) Inventors: James M. Costanza, Flower Mound, TX (US); Rahul Sharma, Fort Worth, TX (US); Michael Cline, Azle, TX (US)

(73) Assignee: KPS GLOBAL LLC, Fort Worth, TX (US)

( * ) Notice: Subject to any disclaimer, the term of this patent is extended or adjusted under 35 U.S.C. 154(b) by 381 days.

(21) Appl. No.: 18/038,621

(22) PCT Filed: May 13, 2021

(86) PCT No.: PCT/US2021/032214

§ 371 (c)(1),
(2) Date: May 24, 2023

(87) PCT Pub. No.: WO2022/115125

PCT Pub. Date: Jun. 2, 2022

(65) Prior Publication Data

US 2024/0011687 A1 Jan. 11, 2024

Related U.S. Application Data

(60) Provisional application No. 63/168,207, filed on Mar. 30, 2021, provisional application No. 63/117,677, filed on Nov. 24, 2020.

(51) Int. Cl.
*F25B 49/02* (2006.01)
*A47F 3/04* (2006.01)
(Continued)

(52) U.S. Cl.
CPC ..... *F25B 49/02* (2013.01); *A47F 3/0447* (2013.01); *F25B 13/00* (2013.01); *F25B 47/025* (2013.01); *F25B 2700/2117* (2013.01)

(58) Field of Classification Search
CPC ..... A47C 3/0447; F25B 49/02
See application file for complete search history.

(56) References Cited

U.S. PATENT DOCUMENTS 3,304,740 A * 2/1967 Balk ..... A47F 3/0447 62/275
3,690,118 A 9/1972 Rainwater
(Continued)

FOREIGN PATENT DOCUMENTS

DE 1451078 A1 10/1970
EP 0 709 046 A2 5/1996
JP S6146384 U 3/1986

OTHER PUBLICATIONS

International Search Report and Written Opinion for Application No. PCT/US21/32214, dated Jul. 15, 2021.
(Continued)

*Primary Examiner* — Nael N Babaa
(74) *Attorney, Agent, or Firm* — MARSHALL, GERSTEIN & BORUN LLP

(57) ABSTRACT

An accessible cooling environment includes a back wall, an opening opposite the back wall, a roof panel, first and second side walls at least partially defining the opening, and an interior space at least partially defined by the back wall, roof panel, and first and second side wall. A fan configured to circulate air through the interior space, an evaporator disposed inside the interior space, and an air curtain assembly configured to form an air barrier adjacent to the opening. The air curtain assembly includes one or more deflectors for separating the air barrier into a first air curtain and a second
(Continued)

air curtain. The first air curtain has a first temperature and the second air curtain has a temperature lower than the first temperature.

25 Claims, 18 Drawing Sheets

(51) Int. Cl.
*F25B 13/00* (2006.01)
*F25B 47/02* (2006.01)

(56) References Cited

U.S. PATENT DOCUMENTS

| | | | | |
|---|---|---|---|---|
| 4,577,467 | A * | 3/1986 | Ibrahim | F25D 21/12 165/146 |
| 4,993,233 | A | 2/1991 | Borton et al. | |
| 5,345,778 | A | 9/1994 | Roberts | |
| 2007/0006604 | A1 | 1/2007 | Behr | |

OTHER PUBLICATIONS

European Patent Application No. 21898860.8, Extended European Search Report, dated Aug. 8, 2024.

* cited by examiner

OPEN-WALLED, TEMPERATURE CONTROLLED ENVIRONMENT

CROSS-REFERENCE TO RELATED APPLICATION

This present application is the US national phase of International Patent Application No. PCT/US2021/032214, filed May 13, 2021, which claims priority to, and the benefit of the filing dates of, U.S. Provisional Application No. 63/117,677, filed Nov. 24, 2020 and U.S. Provisional Application No. 62/168,207, filed Mar. 30, 2021. Each of the priority applications, US 63/117,677, US 62/168,207, is hereby incorporated by reference in its entirety.

FIELD OF DISCLOSURE

The present disclosure generally relates to a cooling environment, and more particularly, to temperature controlled cooling environment having an open wall.

BACKGROUND

Refrigerated enclosures and refrigerated display cases are common storage solutions for produce and other products requiring refrigeration in supermarkets throughout the world. Some enclosures may be small scale solutions, where a customer can open a door of a refrigerated case to access shelves of produce or reach into an open refrigerated display case. Other enclosures may be large scale solutions, where a customer may enter an enclosed refrigerated environment or large space to access refrigerated products. However, both small and large scale refrigeration systems face challenges in both keeping the product cool while reducing heat transfer into the refrigerated space when either a door or an entrance to the refrigerated space is open to ambient temperatures.

SUMMARY

In accordance with a first exemplary aspect of the present disclosure, an accessible cooling environment may include a back wall, an opening opposite the back wall, a roof, first and second side walls at least partially defining the opening, and an interior space at least partially defined by the back wall, roof, and first and second side walls. A barrier may be disposed in the opening and extending between the first and second side walls, the barrier movable from a closed position, in which the barrier sealingly engages a floor and an open position, in which the barrier is spaced away from the floor. An evaporator may be disposed in the interior space and having an input and a coil. A control system may be connected to the evaporator. The control system may include at least one sensor coupled to the evaporator and configured to capture sensor data associated with a temperature of at least one of the input and the coil of the evaporator. The control system may include one or more processors and a memory communicatively coupled to the one or more processors and storing executable instructions that, when executed by the one or more processors, causes the one or more processors to receive the sensor data captured by the at least one sensor, analyze the sensor data to identify a status or condition associated with the evaporator, and send a signal to the evaporator to heat or cool based on the status or condition identified.

In accordance with a second exemplary aspect of the present disclosure, an accessible cooling environment may include a back wall, an opening opposite the back wall, a roof panel, first and second side walls at least partially defining the opening, and an interior space at least partially defined by the back wall, roof panel, and first and second side walls. A fan may be configured to circulate air through the interior space and an evaporator may be disposed inside the interior space. An air curtain assembly may be configured to form an air barrier adjacent to the opening. The air curtain assembly may include one or more deflectors for separating the air barrier into a first air curtain and a second air curtain. The first air curtain may have a first temperature and the second air curtain may have a temperature lower than the first temperature.

In further accordance with any one or more of the foregoing first and second exemplary aspects, an accessible cooling environment may include any one or more of the following preferred forms.

In one preferred form, the accessible cooling environment may include an air curtain assembly.

In a preferred form, the air curtain assembly may include a fan and one or more deflectors.

In a preferred form, the fan and the one or more deflectors may be configured to form an air barrier and channel the air barrier adjacent the opening.

In a preferred form, the air barrier may include a first air curtain at a first temperature and a second air curtain at a second temperature lower than the first temperature.

In another preferred form, the one or more deflectors of the air curtain assembly may be disposed between the opening and the fan to separate the first and second air curtains.

In another preferred form, the air barrier may include a third air curtain having a temperature lower than the temperature of the second air curtain.

In a preferred form, the temperature of the first air curtain may be in a range of approximately 40 degrees Fahrenheit to approximately 50 degrees Fahrenheit.

In a preferred form, the temperature of the second air curtain may be in a range of approximately 33 degrees Fahrenheit to approximately 40 degrees Fahrenheit.

In a preferred form, the temperature of the third air curtain may be in a range of approximately 25 degrees Fahrenheit to 33 degrees Fahrenheit.

In a preferred form, the first air curtain may be adjacent to the opening, the third air curtain may be adjacent to the interior space, and the second air curtain may be disposed between the first and the third air curtains.

In a preferred form, the at least one sensor may include a first sensor disposed at the input of the evaporator and a second sensor disposed in the coil of the evaporator.

In a preferred form, the one or more processors may be configured to compare sensor data at the input of the evaporator with the sensor data in the coil of the evaporator.

In a preferred form, the one or more processors may be configured to compare sensor data of the at least one sensor.

In a preferred form, the one or more processors may be configured to send a signal to the evaporator to raise the temperature of the evaporator to initiate a defrost cycle.

In a preferred form, a seal may be disposed between the barrier and at least one of the first and second side walls.

In a preferred form, the seal disposed between the barrier and the at least one of the first and second side walls may be a brush seal.

In a preferred form, a seal may be disposed between the barrier and the floor when the barrier is in the closed position.

In a preferred form, the seal disposed between the barrier and the floor may be a bulb seal.

In a preferred form, a barrier may be disposed in the opening and extend between the first and second side walls.

In a preferred form, the barrier may be movable from a closed position, in which the barrier sealingly engages a floor and an open position, in which the barrier is spaced away from the floor.

In a preferred form, a seal disposed between the barrier and at least one of the first and second side walls.

In a preferred form, the seal disposed between the barrier and the floor may be a compressible seal.

In a preferred form, the barrier may at least partially channel air flow of the air barrier.

In a preferred form, the accessible cooling environment may include a defrost system connected to the evaporator.

In a preferred form, the defrost system may include at least one sensor coupled to the evaporator and configured to capture sensor data associated with a temperature of at least one of an input and a coil of the evaporator.

In a preferred form, the at least one sensor includes a first sensor disposed at the input of the evaporator and a second sensor disposed inside of the evaporator.

In a preferred form, the defrost system may include one or more processors.

In a preferred form, the defrost system may include a memory communicatively coupled to the one or more processors and storing executable instructions that, when executed by the one or more processors, may cause the one or more processors to receive sensor data captured by the at least one sensors, analyze the sensor data to identify a status or condition associated with the evaporator, and send a signal to the evaporator to heat or cool based on the status or condition identified.

In a preferred form, an embedded heating element may be disposed adjacent to the opening.

In a preferred form, the air curtain assembly may include a blower and at least one fan of the evaporator.

In a preferred from, the fan may include a blower at least partially disposed outside of the interior space.

In a preferred form, the fan may include multiple fans of the evaporator.

DETAILED DESCRIPTION

The present disclosure is generally directed to an open-wall cooler ("OWC") unit, also referred herein as an accessible cooling environment unit, an open-walled, temperature-controlled environment, and an open-walled refrigeration unit, which may be a standalone unit or configured in a layout comprising a plurality of OWC units. The OWC unit may replace existing small and large scale refrigeration solutions by providing an energy-efficient refrigerated environment that is easy to construct and provides a comfortable shopping experience for the consumer.

Figure 1:
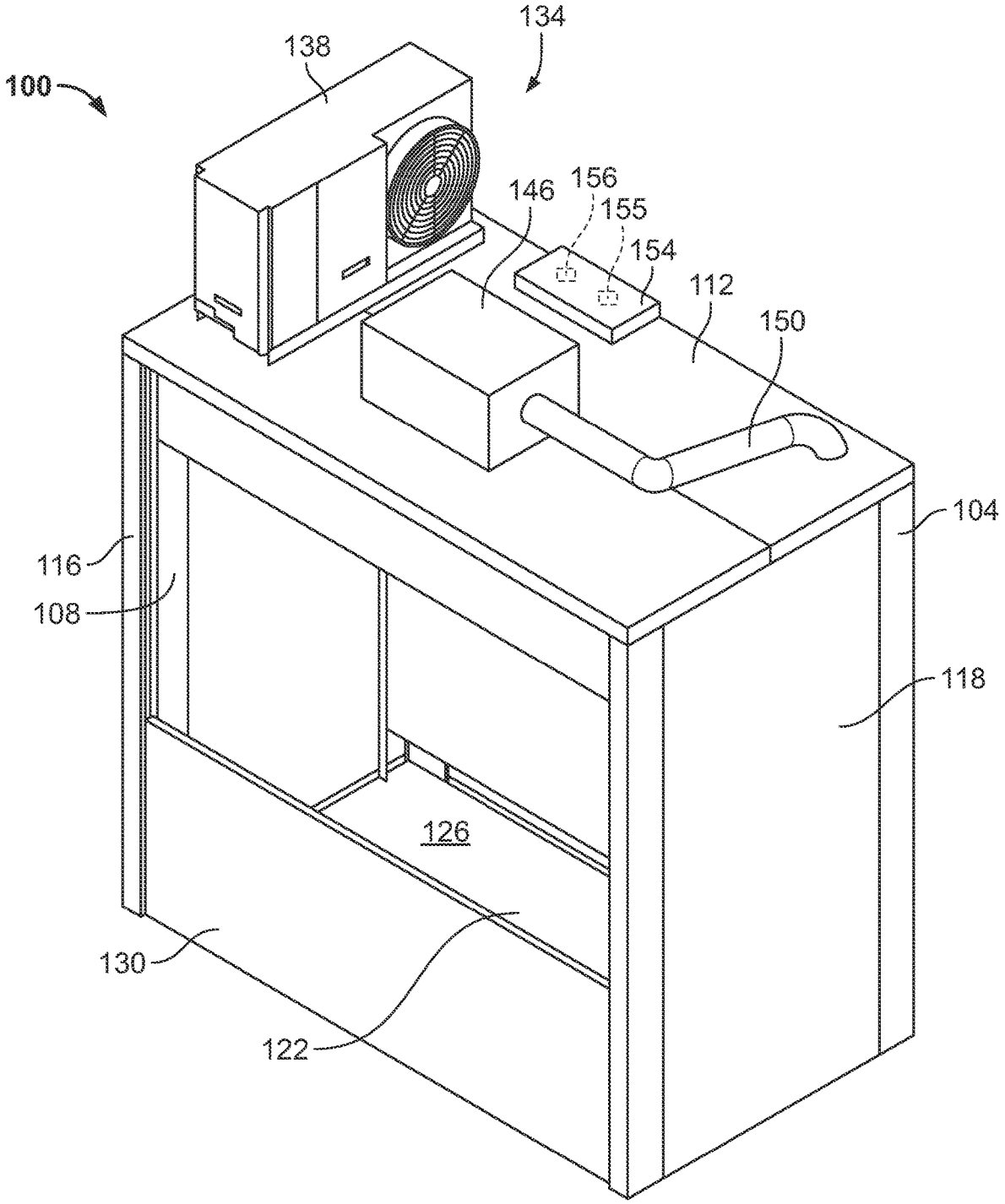
FIG. 1 is a perspective view of an open-wall cooler ("OWC") unit assembled in accordance with the teachings of the present disclosure.
Figure 7:
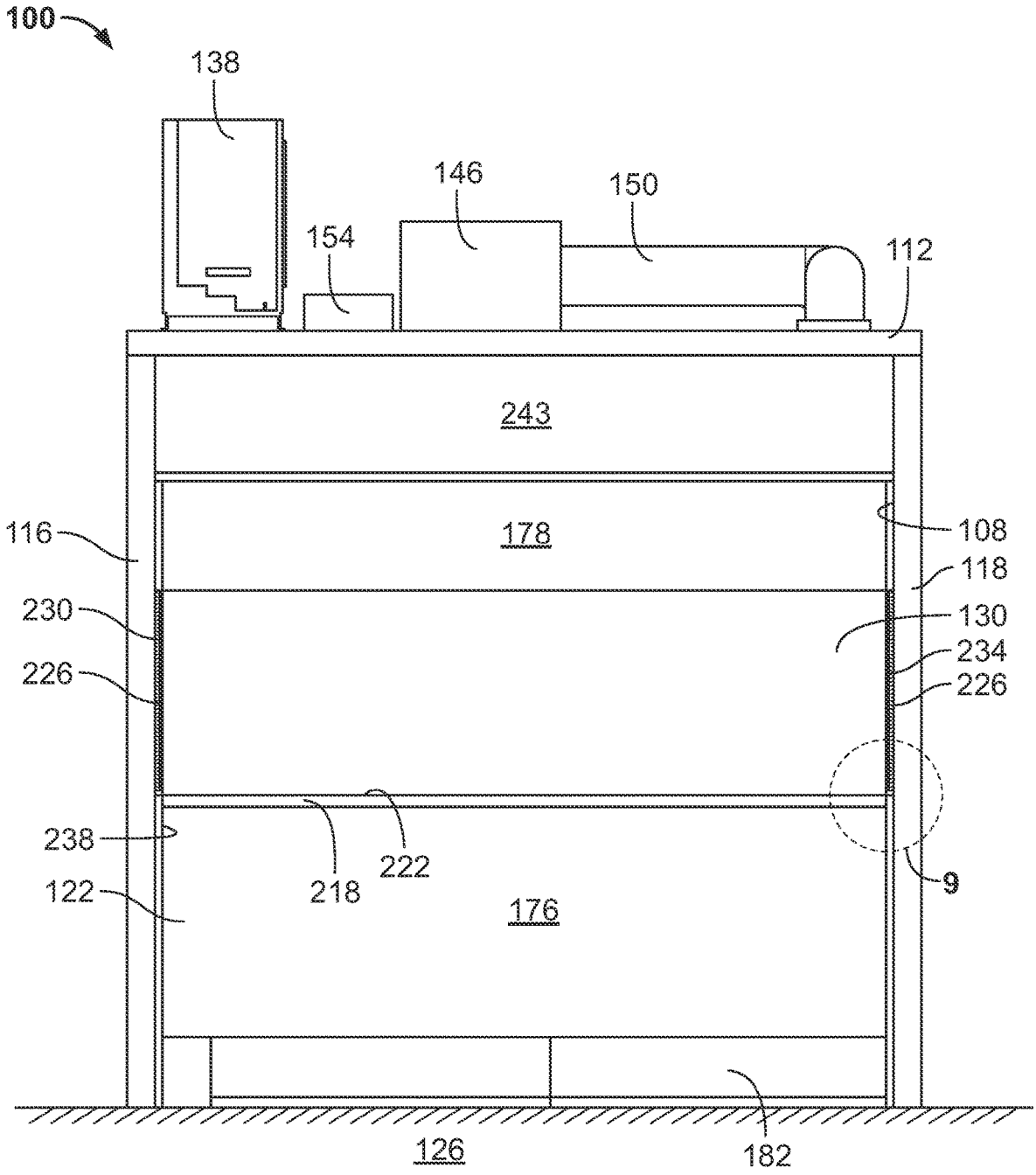
FIG. 7 is a front view of the OWC unit of FIG. 1, illustrating the movable barrier in an open position.

In FIG. 1, an OWC unit 100 is assembled in accordance with the teachings of the present disclosure. The OWC unit 100 is a partially enclosed, refrigerated storage space including a back wall 104, an opening 108 opposite the back wall 104, a roof 112, and first and second side walls 116, 118 that partially define the opening 108. An interior space 122 is defined by a ground or floor surface 126, the back wall 104, roof panel 112, and first and second side walls 116, 118. A barrier 130 also at least partially defines the interior space 122 and is disposed in the opening 108 between the first and second side walls 116, 118. The barrier 130 sealingly engages the floor or ground 126 when in the closed position, and is movable to an open position (as shown in FIG. 7), in which the barrier 130 is spaced away from the floor or ground 126. As will be discussed further below, the barrier 130 provides the OWC unit 100 with both a physical and thermal barrier from the external environment.

The OWC unit 100 has a refrigeration system 134 that maintains the temperature of the interior, and distributes refrigerated air throughout the interior space 122. The refrigeration system 134 includes a condenser 138 disposed on the roof 112, an evaporator 142 (shown in FIG. 2) disposed in the interior space 122, a blower 146 disposed on the roof 112, and an insulated duct 150 connecting the blower 146 and the interior space 122 of the OWC unit 100. A control system 154 is disposed on the roof 112, the interior space 122, or in the evaporator 142, and is coupled to the refrigeration system 134 to monitor, analyze, and control the refrigeration system 134 of the OWC unit 100. For example, the control system has a demand defrost cycle that keeps the evaporator 142 functioning at high efficiency. The control system 154 may be operated remotely or locally to operate the defrost cycle, change temperature or fan speed, or control and/or operate other functions of the refrigeration system 134. The control system 154 may include one or more sensors coupled to the evaporator 142 or other areas in the interior space 122 of the OWC unit 100, one or more processors 155, and a memory 156 for storing executable instructions that enables automatic operation of the defrost cycle and/or other features or programs of the refrigeration system 134. While the refrigeration and control systems 134, 154 are arranged on (or near) the roof 112 of the OWC unit, in other examples, the refrigeration and control systems 134, 154 may be arranged differently. For example, the blower 146, the condenser 138, and the control system 154 may be disposed on the exterior of the OWC unit 100, on the ground 126, or attached to any of the panels defining the OWC unit 100.

The roof 112, sidewalls 116, 118, and back wall 104 of the OWC unit 100 of FIG. 1 are preferably constructed using connected insulated panels. The roof 112 may be constructed of one or more insulated panels joined together. Similarly, each of the first and second side walls 116, 118 includes a single insulated panel that is connected to the both the roof 112 and the back panel 104 via insulated frames. The back panel 104 may include one or more joined insulated panels that attach to the roof and the first and second sidewalls 116, 118. In one example, the OWC unit 100 may have a length (i.e., extending between the first and second side walls 116, 118) of approximately 9 feet, a height (i.e., extending between the ground surface 126 and the roof 112) of approximately 9 feet, and a width (i.e., measured between the opening 108 and the back wall 104) of approximately 5 feet. However, in other exemplary OWC units 100, these dimensions may vary. For example, the side walls 116, 118 and/or back wall 104 may include a plurality connected insulated panels depending on the desired size and shape of the OWC unit 100. In other words, the OWC unit 100 may be customized. The panels may be connected to each other by a hybrid insulated frame, such as the hybrid frames disclosed in U.S. Pat. No. 10,246,873, filed Nov. 16, 2017, titled "Insulated Structural Members for Insulated Panels and a Method of Making Same," U.S. application Ser. No. 16/663,910, filed on Oct. 25, 2019, titled "Method of Manufacturing Hybrid Insulation Panel," and U.S. application Ser. No. 16/582,147, filed Sep. 25, 2019, titled "Hybrid Insulating Panel, Frame, and Enclosure," which are hereby incorporated by reference. In other examples, the frames may be wood, metal, composite, foam, or a combination of materials.

Figure 2:
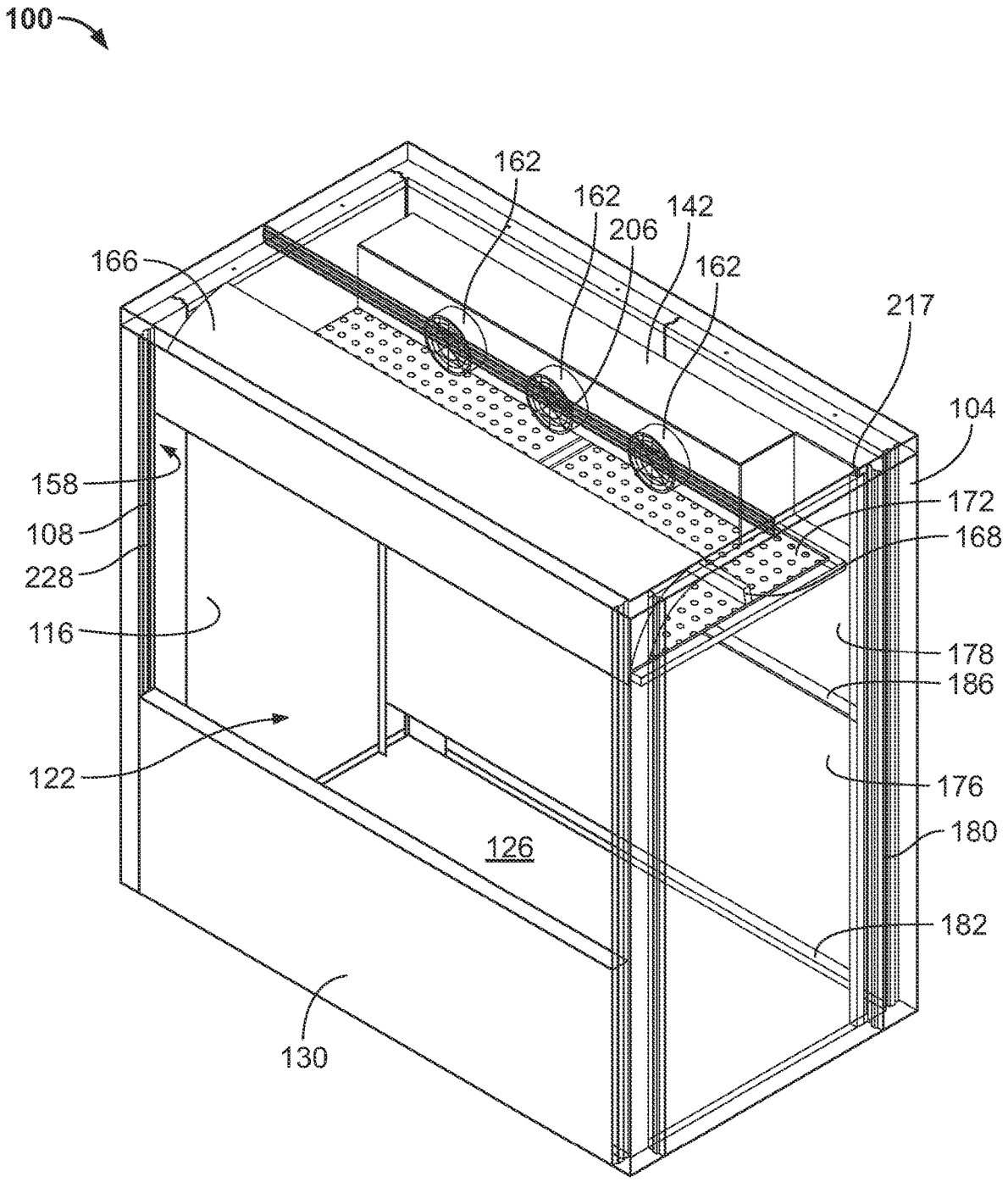
FIG. 2 is a perspective view of the OWC unit of FIG. 1, illustrating an interior of the OWC unit with a roof and side panels hidden from view.

Turning now to FIG. 2, a partial OWC unit 100 of FIG. 1 is illustrated. In FIG. 2, a portion of an air curtain assembly 158 is depicted and includes one or more fans or blowers 162 of the evaporator 142, one or more deflectors 166, 167, 168, one or more perforated ceiling plates 172, and one or more back wall plates 176, 178 disposed in the interior space 122 of the OWC unit 100. However, the air curtain assembly 158 also includes the blower 146 of FIG. 1, which is hidden in FIG. 2 for illustrative purposes. In this way, air is circulated through the OWC unit 100 by the blower 146 and/or the fans 162 of the evaporator 142. The air curtain assembly 158 is configured to form and shape an air barrier 190 (in FIGS. 3 and 4) adjacent the opening 108 of the OWC unit 100 to reduce air exchange across the opening 108 and to bathe a product disposed in the interior space 122 with constant cold air. The barrier 130 also helps guide air flow from the opening 108, against the ground 126, and toward the back wall 104 within the interior space 122 of the OWC unit 100. At the back wall 104, air is then channeled into a duct 180 formed between the back wall 104 and the back wall plates 176, 178, where the air may be recirculated through the evaporator 142 or through the blower 146 and back into the OWC unit 100.

A first and second curved deflectors 166, 167 of the air curtain assembly 158 are curved turning vanes disposed in the interior space 122 adjacent to the roof 112 and between the fan 162 of the evaporator 142 and the opening 108 of the unit 100. The two curved deflectors 166, 167 create a plenum that channels the air into a first air curtain. The first curved deflector 166 forms one side of the plenum and the second curved deflector 167 creates the other side of the plenum. The two curved deflectors 166, 167 create a sealed channel (like a funnel) where the air from the blower 146 flows through it and into the first air curtain. A third deflector 168 is an angled plate extending between the first and second side walls 116, 118 and disposed between the perforated ceiling plate 172 and the roof 112. The deflectors 166, 167, 168 are positioned within the flow path of the recirculated air of the OWC unit 100 to channel the air into separate pathways and at separate temperatures to create the vertical air barrier 190 at the opening 108. The deflectors 166, 167, 168 may be metal deflectors, plastic honeycomb diffusers, or a combination of materials. As will be explained in further detail below, the deflectors 166, 167, 168 channel air into multiple air curtains where each air curtain has a different temperature to provide a temperature gradient at the opening 108 of the OWC unit 100 that limits heat exchange at the opening 108.

As shown in FIG. 2, a first wall plate 176 is spaced from the ground 126 and spaced from a second wall plate 178, thereby forming a first opening or slot 182 with the ground 126 and a second opening or slot 186 with the second wall plate 178. Air flows through either the first or second openings 182, 186 into the duct 180. The ceiling plate 172 allows airflow into the product space of the interior space 122 of the OWC unit 100. In operation, the air curtain assembly 158 limits air intrusion into the interior space 122 of the OWC unit 100 and facilitates cooling of the product in the interior space 122. The fans 162 of the evaporator 142 and the blower 146 on the roof 112 direct air towards the opening 108, and the deflectors 166, 167, 168 divert the air to form a vertical air barrier and to distribute cool air evenly throughout the interior space 122. The air from the air barrier 190 then circulates through the back duct 180 and either into the duct 150 and the blower 146 or into an input of the evaporator 142.

Figure 2A:
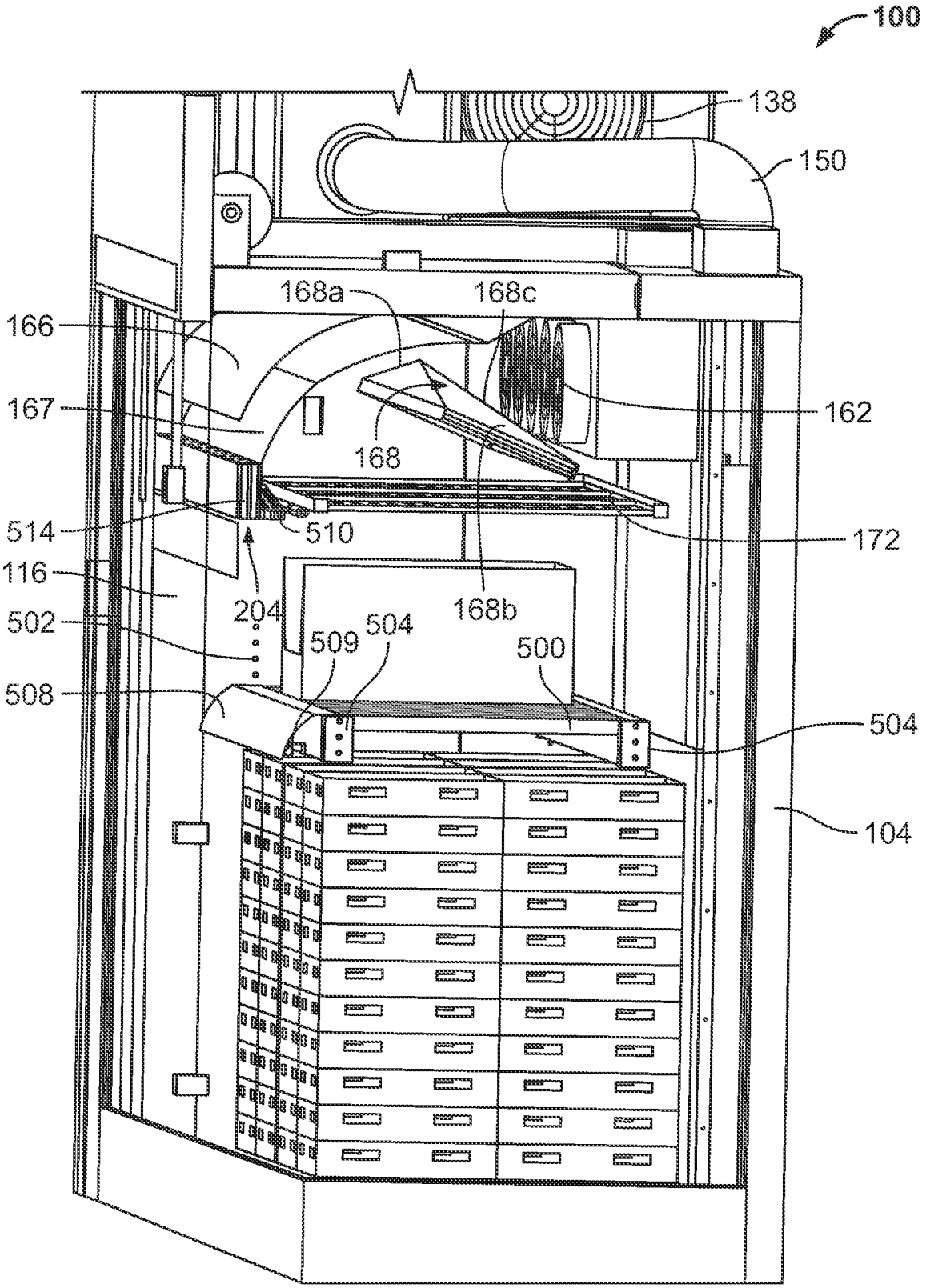
FIG. 2*a* is a perspective view of an alternate version of an OWC unit of the present disclosure, illustrating an interior of the OWC unit with a side panel hidden from view.

As illustrated in a second exemplary OWC unit 100 shown in FIG. 2*a*, the deflector 168 may itself have multiple surfaces that are angled with respect to one another, to further direct air flow in desired directions. For instance, the deflector 168 may include inclined surfaces 168*a* and 168*b* that are pitched at an angle, lower toward a rear of the OWC unit 100 and higher toward a front of the OWC unit 100, with the inclined surfaces 168*a*, 168*b* meeting along an apex 168*c*, such as along a center line of the OWC unit 100, and each of the inclined surfaces 168*a*, 168*b* depending downwardly from the apex 168*c* in a direction toward respective side walls 116, 118 of the OWC unit 100. The apex flattens toward the rear of the OWC unit 100.

Figure 3:
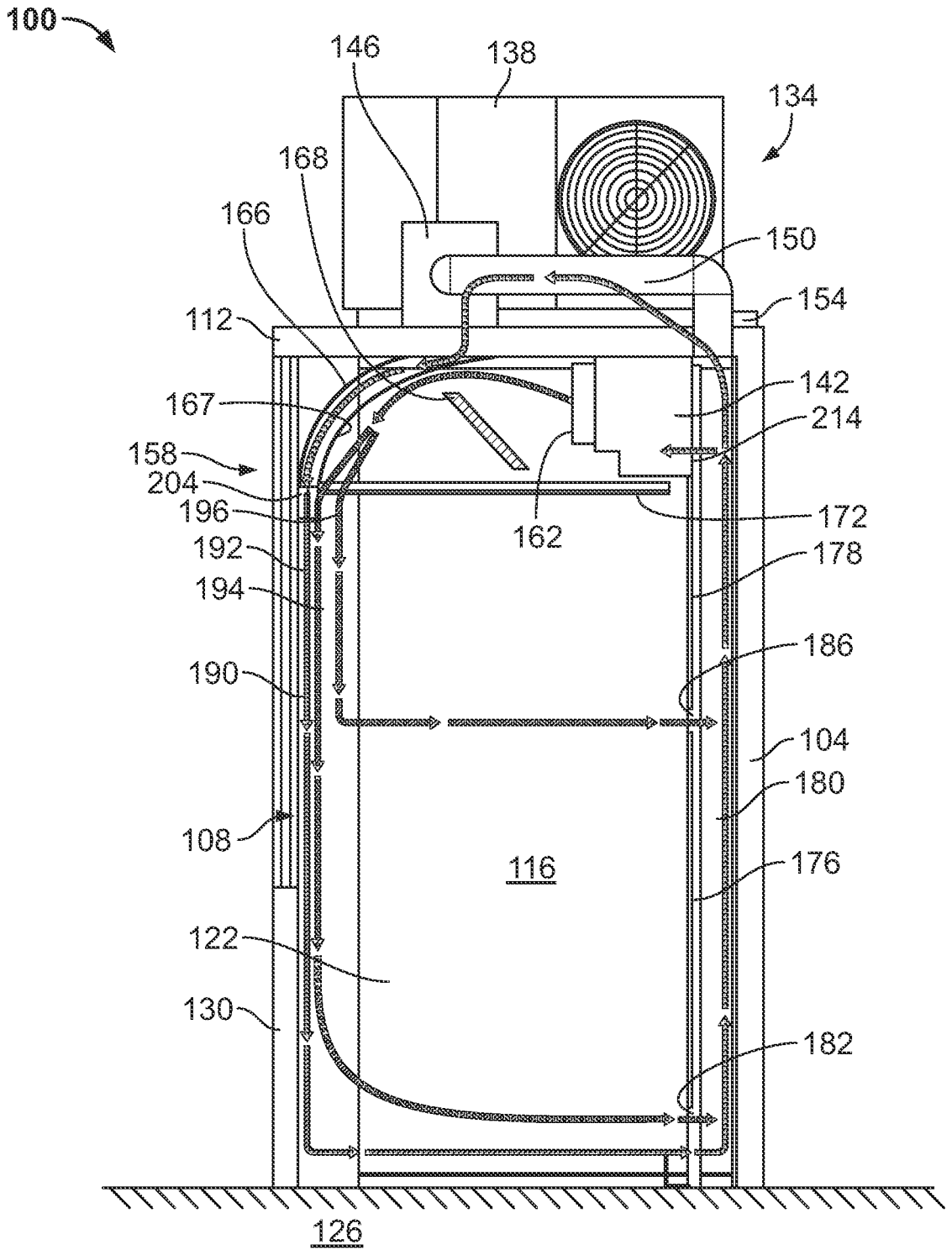
FIG. 3 is a cross-sectional side view of the OWC unit of FIG. 1, illustrating air flow through the OWC unit.
Figure 4:
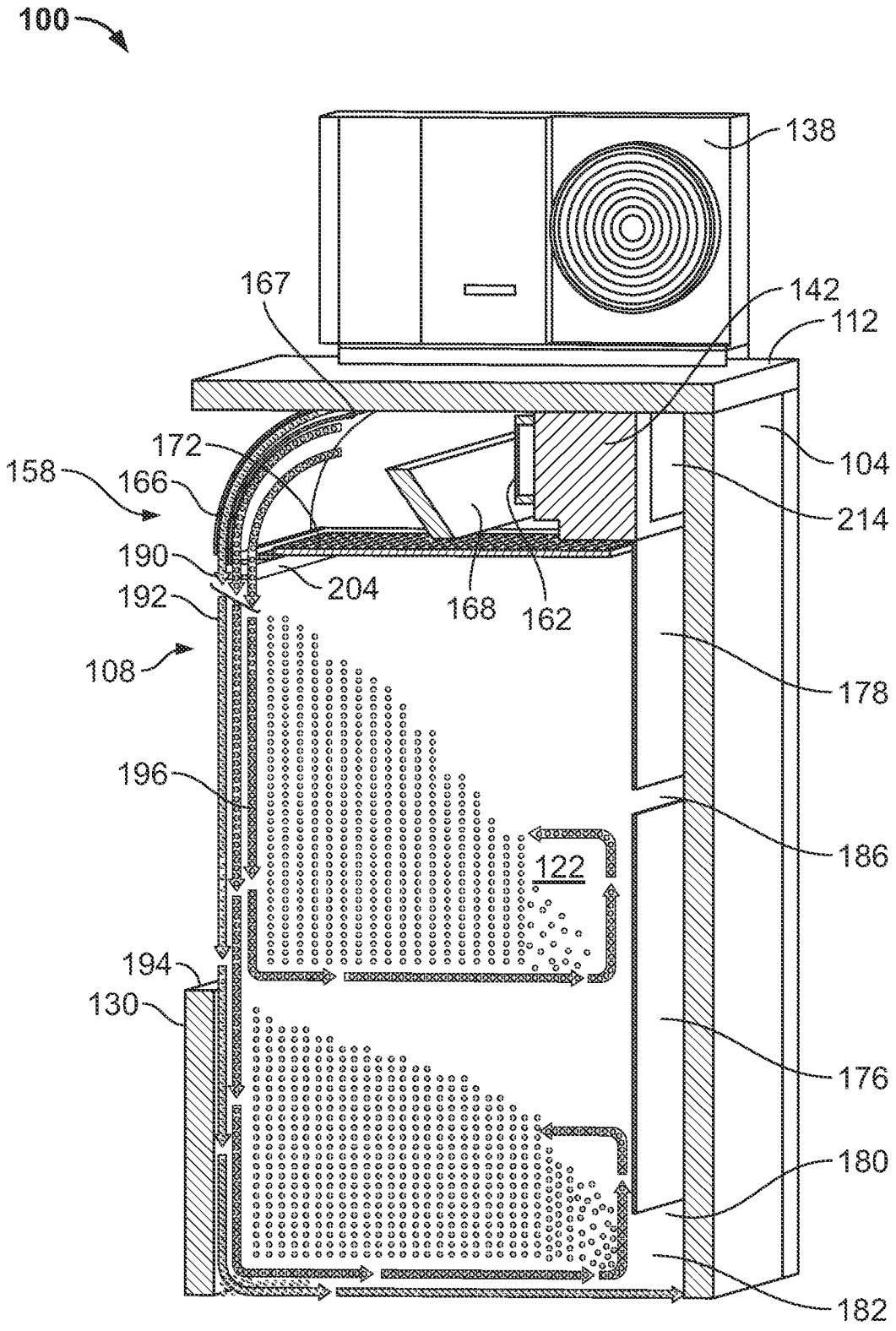
FIG. 4 is a perspective, cross-sectional view of the OWC unit of FIG. 1, illustrating an air barrier formed by first, second, and third air curtains.
Figure 4A:
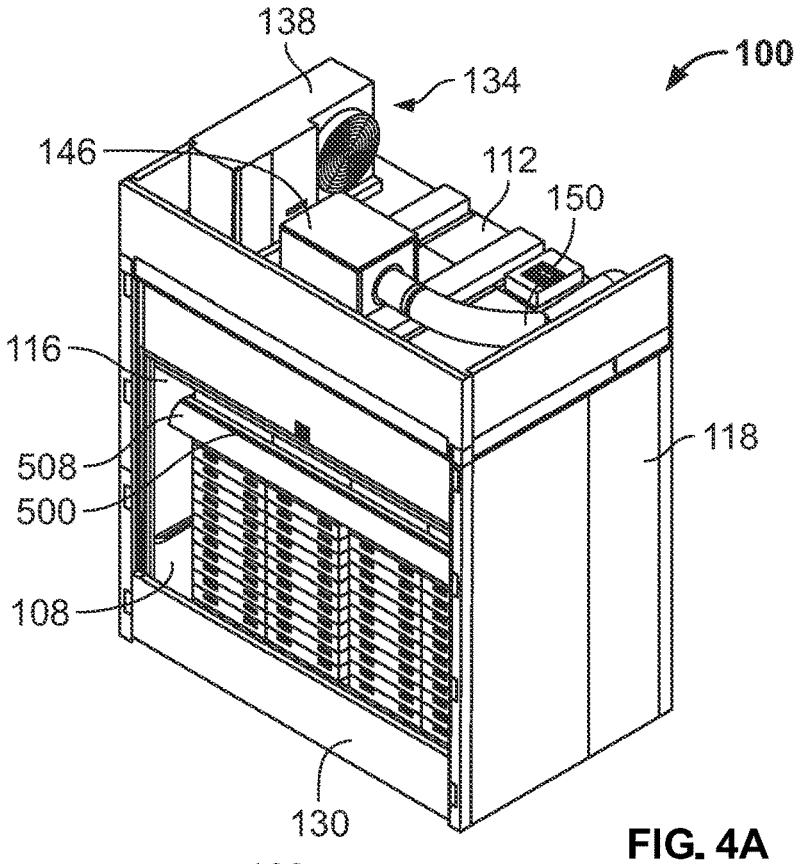
FIG. 4*a* is a perspective view of the alternate version of the OWC unit illustrated in FIG. 2*a;*
Figure 4B:
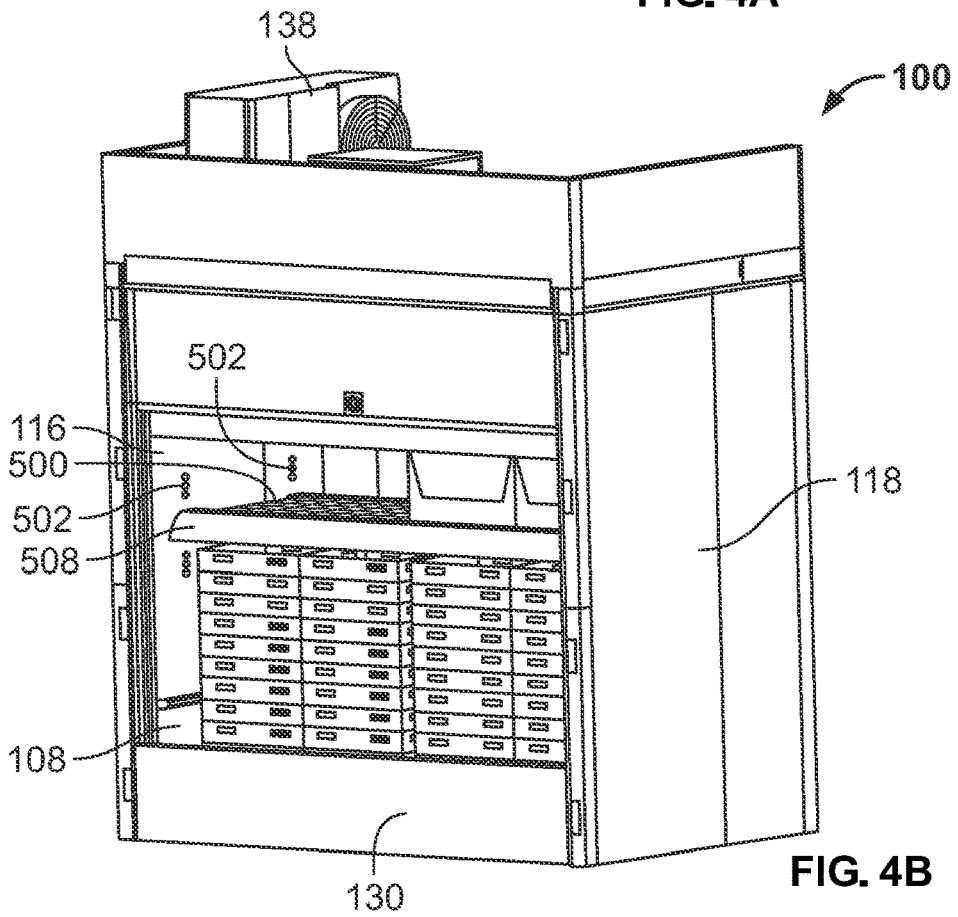
FIG. 4*b* is a front, right perspective view of the OWC unit illustrated in FIG. 4*a;*

As shown in FIG. 3, air is recirculated through the OWC unit 100 according to the exemplary flow diagram. The vertical air barrier 190 is formed at the opening 108 and includes a first air curtain 192, a second air curtain 194, and a third air curtain 196. The first, second, and third air curtains 192, 194, 196 each have a different temperature in a particular temperature range; the third air curtain 196 has the lowest temperature of the three air curtains 192, 194, 196. The refrigeration system 134 and air curtain assembly 158 operate together to maintain the temperature of each air curtain 192, 194, 196 in each respective temperature range. While the illustrated example of the air barrier 190 includes three air curtains 192, 194, 196, in other examples the air barrier 190 may include more or fewer than three air curtains 192, 194, 196. Additionally, while the air barrier 190 is oriented to flow across the opening 108 in a vertical direction, in other examples, the air barrier may be oriented differently, such as horizontally, or at a different angle, depending on the location of the air curtain assembly 158.

The first air curtain 192 is adjacent to the opening 108 and has the highest curtain temperature. For example, the temperature of the first air curtain 192 is in a range of approximately 40 degrees Fahrenheit to approximately 50 degrees Fahrenheit, and preferably around 45 degrees Fahrenheit. The blower 146 channels air through an opening in the roof 112, into the interior space 122 and between the curved deflectors 166, 167 to form the first air curtain 192. A honeycomb diffuser assembly 204, which may include one or more diffusers, is disposed at a bottom of the deflectors 166, 167 and receives the first and second air curtains 192, 194. The honeycomb assembly 204 conditions the air flow to create laminar airflow across the opening 108 by reducing turbulence. The air flow forms the first air curtain 192 by flowing across the opening 108 in a vertical direction. The barrier 130 directs air flow from the first air curtain 192 into the interior 122 of the OWC unit 100 and against the ground 126. The air then flows across the ground 126 toward the back wall 104, and through the first opening 182 of the back wall plate 176 and into the back duct 180. A portion of the air from the first curtain 192 is then channeled through the duct 150 connected to the roof 112 and through to the blower 146 to be recycled again through the OWC unit 100. The air that forms the first air curtain 192 cycles along this path and does not enter the evaporator 142.

The second air curtain 194 of the air barrier 190 is formed between the first and third air curtains 192, 196. Refrigerated air exiting the outlet fans 162 of the evaporator 142 enters the interior space 122 of the OWC unit 100 and forms either the second air curtain 194 or the third air curtain 196. The angled and curved deflectors 168, 166, and 167 direct the cooled air through a space between the curved deflector 167 and an outer edge of the perforated ceiling plate 172, forming the second air curtain 194. In this way, the curved deflectors 166, 167 separate the first and second air curtains 192, 194 that form the air barrier 190 adjacent to the opening 108. The curved deflector 167 also shapes the air from the evaporator 142 and directs it into the second air curtain 194. A portion of the air being directed into the second air curtain 194 splits off and forms the third air curtain 196. The air from the second air curtain 194 flows into the honeycomb assembly 204 and across the opening 108 and into the interior space 122 of the OWC unit 100. A portion of the air from the second air curtain 194 may reach the ground another portion may flow across a lower portion of the interior space 122 (i.e., where stored product will be placed) and through the first opening 182 of the back wall plate 176 and into the back duct 180, and another portion may flow through the optional second opening 186. The air from the second air curtain 194 flows through the back duct 180 in a vertical direction and into an intake or input 214 of the evaporator 142 to be recycled again through the OWC unit 100. The temperature of the second air curtain 194 is in a range of approximately 30 degrees Fahrenheit to approximately 40 degrees Fahrenheit, and preferably around 34 degrees Fahrenheit.

The third air curtain 196 is adjacent to the second air curtain 194 and the interior space 122 of the OWC unit 100. The third air curtain 196 has a temperature in a range of approximately 25 degrees Fahrenheit to approximately 35 degrees Fahrenheit, and preferably around 32 degrees Fahrenheit. As such, the third air curtain 196 has the lowest temperature of the air barrier 190. Similar to the second air curtain 194, cooled air exiting the evaporator 142 is channeled toward the opening 108 of the OWC unit 100. The third air curtain 196 flows partially across the opening 108 and into an upper portion of the interior space 122 and through the second opening 186 formed by the back wall plates 176, 178. The air then flows into the input 214 of the evaporator 142 to be recycled again through the OWC unit 100. In addition to the first air curtain 192, a portion of the air from the second and third air curtains 194, 196 can be recirculated in normal operations through the blower 146 and into the interior space 122.

Figure 4C:
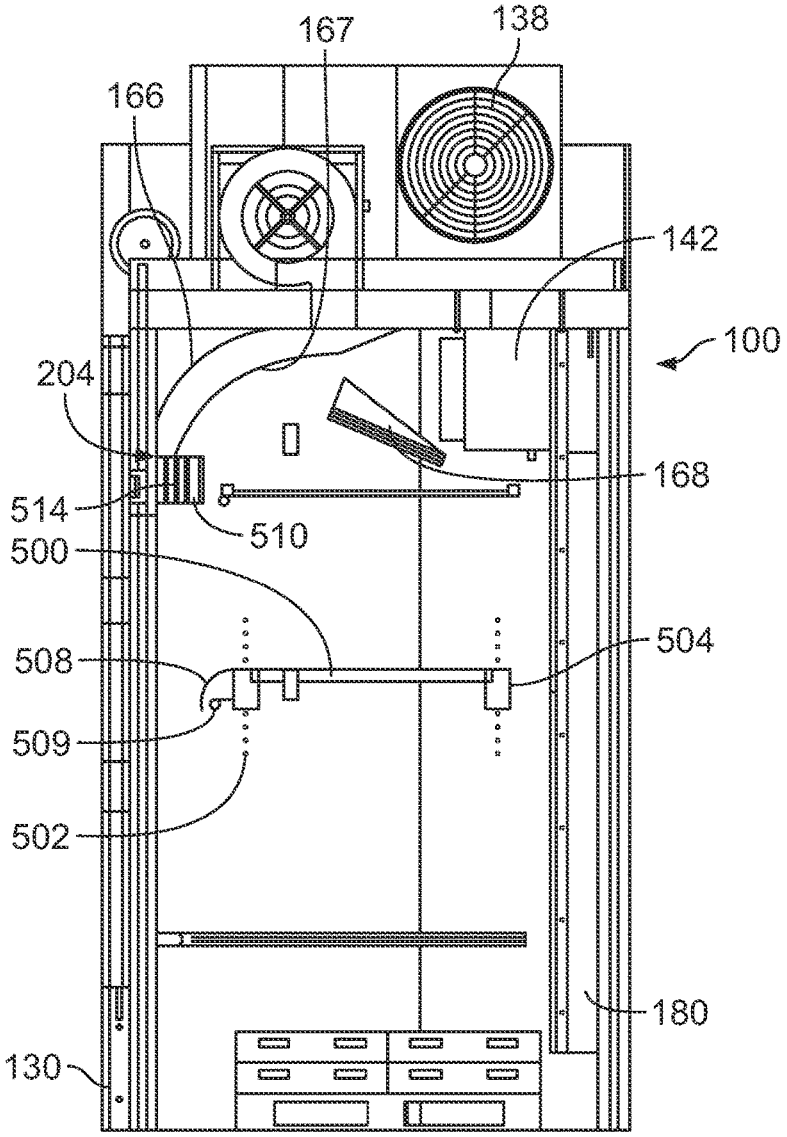
FIG. 4*c* is a cross-sectional side view of the OWC unit illustrated in FIG. 4*a;*
Figure 4D:
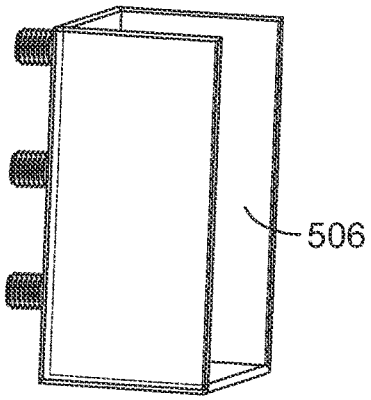
FIG. 4*d* is a an enlarged view of a shelf support beam saddle of a height-adjustable shelf of the OWC unit of FIG. 4*a;*
Figure 4E:
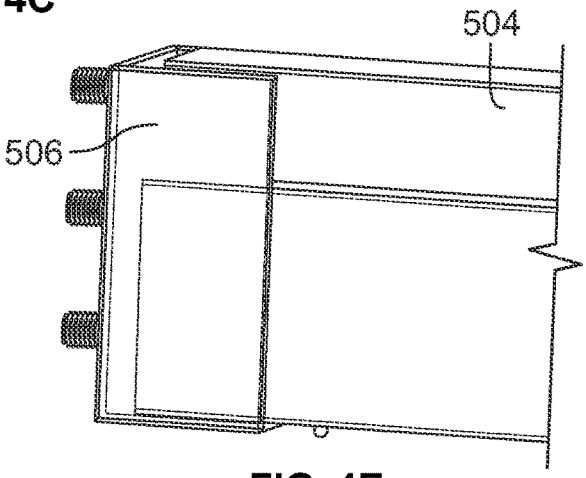
FIG. 4*e* is an enlarged, partial view of a shelf support beam coupled to the shelf support beam saddle of FIG. 4*d;*
Figure 4F:
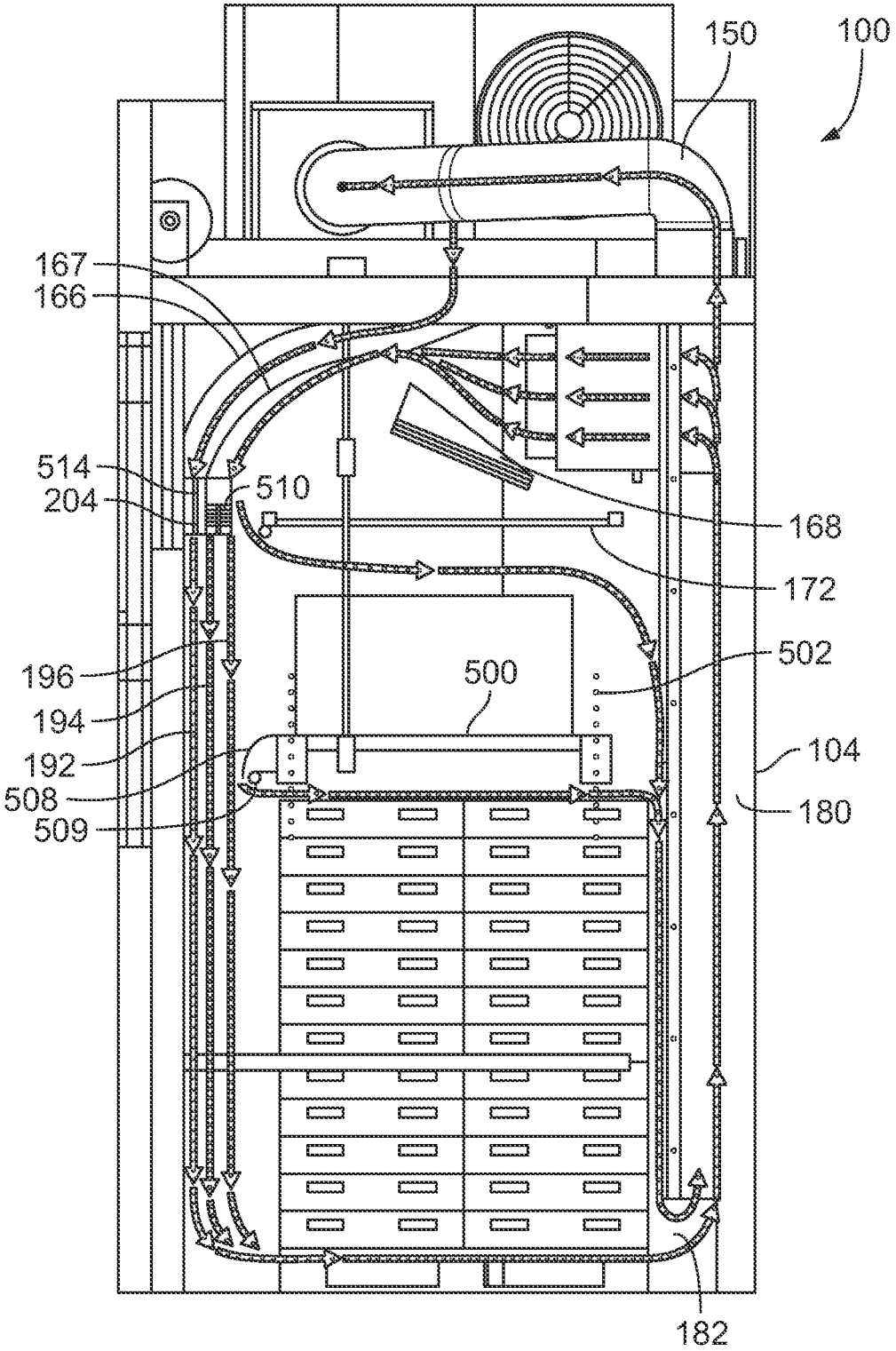
FIG. 4*f* is a cross-sectional side view of the OWC unit of FIG. 4*a*, illustrating air flow through the OWC unit.

Turning to FIGS. 4*a*-4*f*, the OWC unit 100 may include a height-adjustable shelf 500. The height-adjustable shelf 500 can be a wire shelf. A plurality of vertically-spaced height adjustment holes 502 can be provided along the side walls 116, 118, which allows the connection via bolts of the rail saddle 506 to the side walls 116, 118. As illustrated in FIGS. 4*d* and 4*e*, to facilitate adjustability, each of the shelf support beam 504 may be seated in a pair of rail saddles 506 with each rail saddle 506 being defined by a floor, an end wall from which the pegs or dowels project, and a pair of spaced side wall members, the spaced side wall members and the floor defining a U-shaped channel to receive the shelf support beam 504. The height-adjustable shelf 500 advantageously provides a support surface for eye-level retail display of merchandise within the OWC unit, above one or more stacks of palletized products.

The height-adjustable shelf 500 is provided with a wing-like curved light/air deflector 508, which serves to protect and direct light from a bulb, such as an elongate LED bulb 509, that is in electrical communication with a power supply for the OWC unit 100. The light 509 may be a different light source such as, for example, electroluminescent tape, phosphor crystals, organic light emitting diodes (OLEDs), fiberglass tubing, photovoltaic cells or arrays, neon or other gas filled lights, or other lighting material. In addition to reflecting light toward the region of the OWC unit 100 and palletized merchandise below the height-adjustable shelf 500, the wing-like curved light/air deflector 508 serves to direct chilled air from second and third air curtains 194, 196 to the bottom front of the palletized product in the OWC unit 100, as can be appreciated with reference to FIG. 4*f*.

Figure 4G:
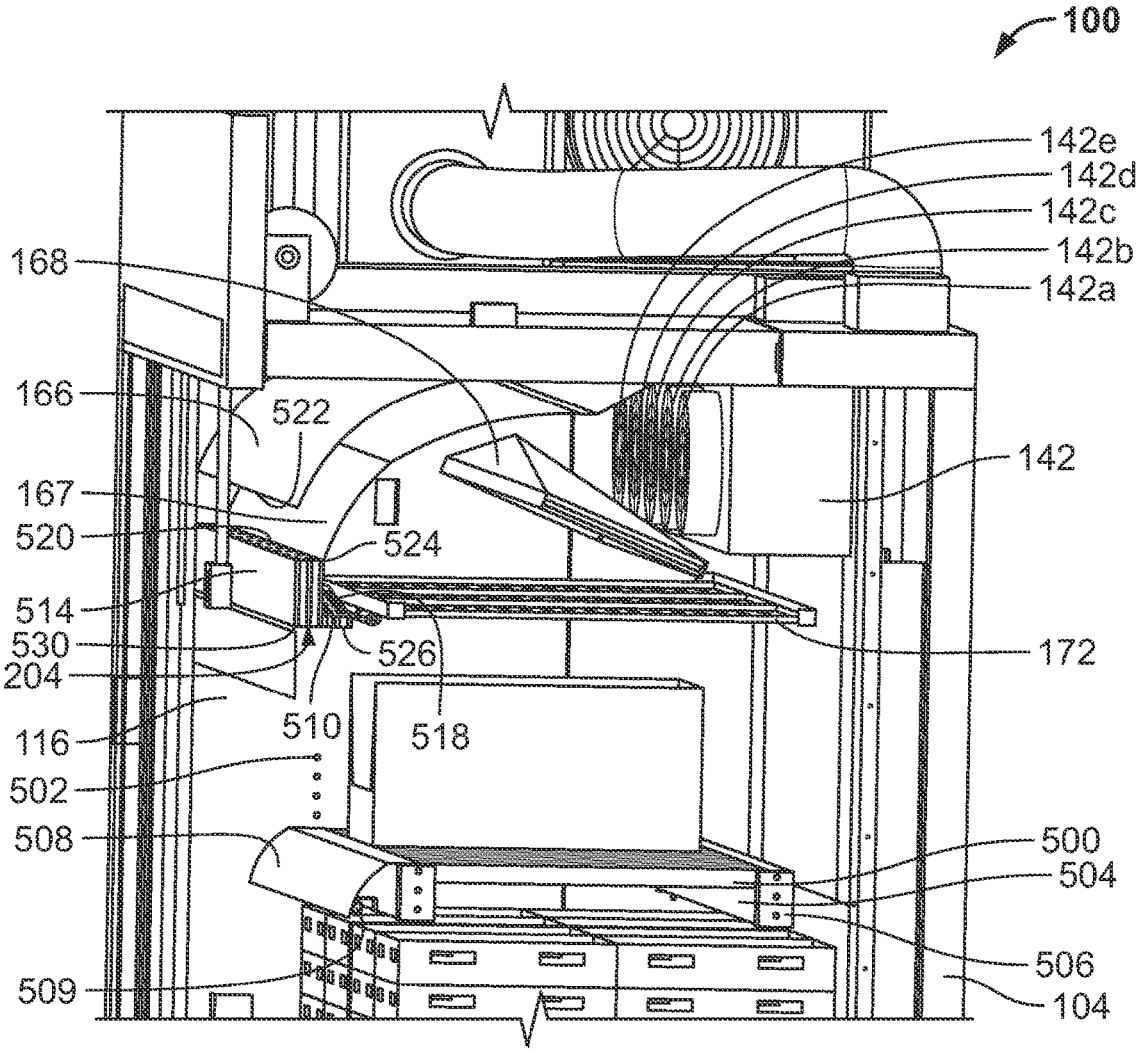
FIG. 4*g* is a partial, perspective view of the OWC unit illustrated in FIG. 4*a*, with the right side wall removed.
Figure 4H:
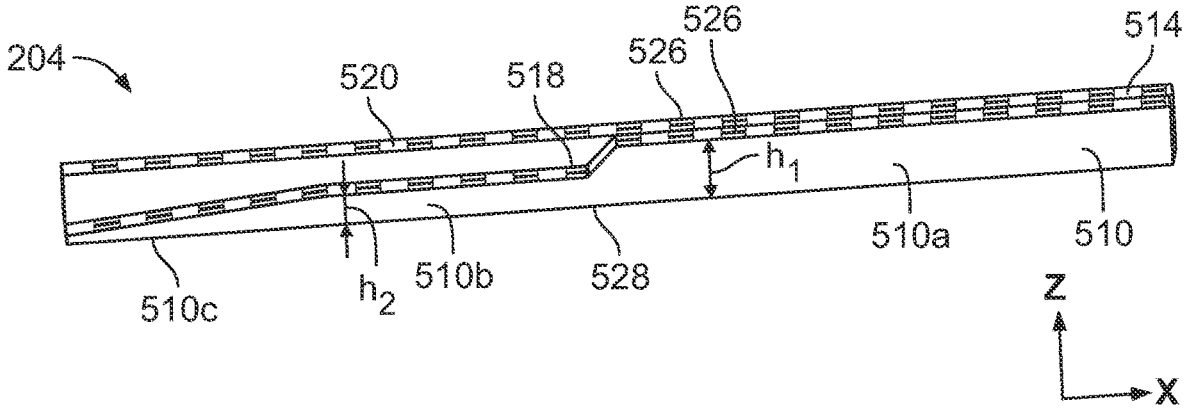
FIG. 4*h* is a perspective view of a honeycomb diffuser assembly of FIG. 4*g;*

With reference to FIGS. 4*g*-4*j*, the honeycomb diffuser assembly 204 is assembled in accordance with the teachings of the present disclosure. The honeycomb diffuser assembly 204 includes a variable-height honeycomb diffuser 510 and a non-variable height diffuser 514. In the illustrated example, the variable-height honeycomb diffuser 510 is used in conjunction with one or more non-variable height diffusers or diffuser sections 514, as shown in FIG. 4*h*.

Figure 4I:
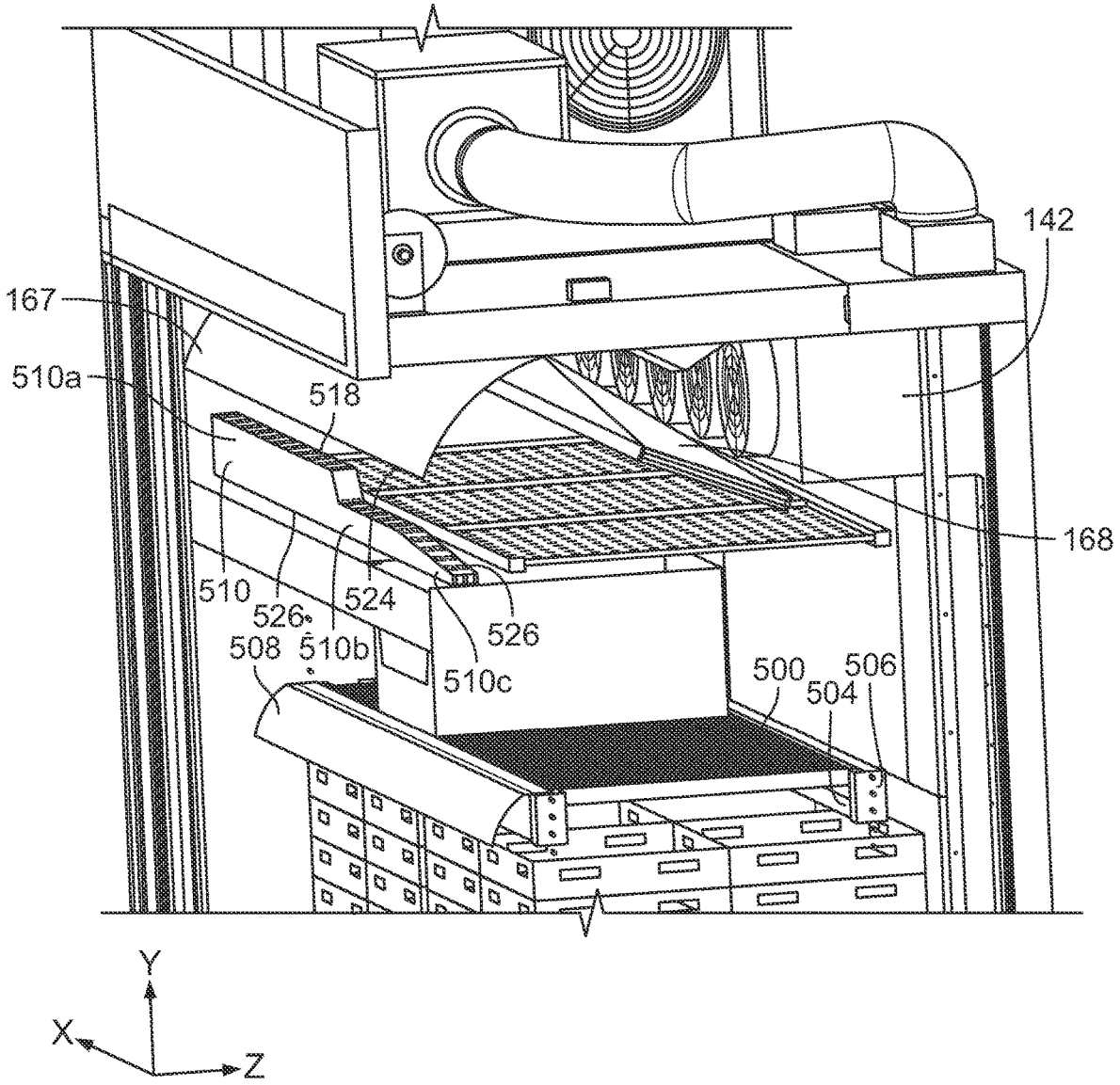
FIG. 4*i* is a partial, perspective view of the OWC unit illustrated in FIG. 4*a* with components hidden to show a first exemplary diffuser.
Figure 4J:
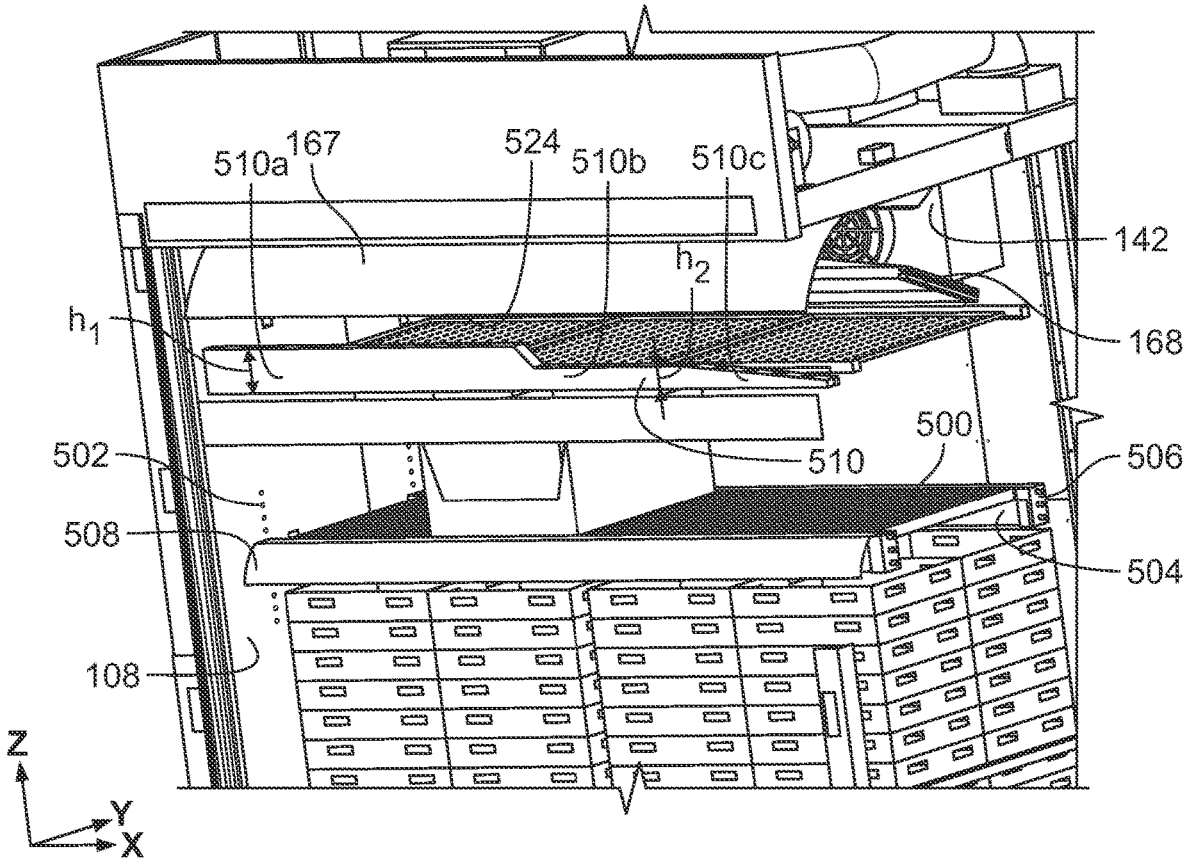
FIG. 4*j* is a front, side perspective view of the OWC unit illustrated in FIG. 4*h;*

However, in other examples, the honeycomb diffuser assembly 204 may include one or more variable height diffusers or one or more non-variable height diffusers. As used herein, "variable height" refers to one or more different heights measured on a Z-coordinate axis, as shown in FIGS. 4*h*-4*j*. The height of the diffuser 510 may vary along a length of the diffuser 510 extending on the X-coordinate axis, or in other words, between the first and second side walls 116, 118 of the OWC unit 100. The diffuser 510 may be sloped, staggered, corrugated, ridged, or otherwise non-planar on one or more of the top and bottom surfaces. In another example, however, the height of the diffuser may instead, or additionally, vary along a width of the diffuser 510 extending in the Y-coordinate axis. Additionally, as used herein, "non-variable height" refers to a uniform height measured on the Z-coordinate axis, such that the diffuser has an even, flat, or horizontal top and/or bottom surfaces.

As shown in FIG. 4*g*, the honeycomb diffuser assembly 204 is disposed immediately rearward of a bottom portion 522, 524 of the first and second deflectors 166, 167 such that an inlet 518, 520 of each diffuser 510, 514, respectively, is proximally located relative to the first and second deflectors 166, 167. As shown in FIGS. 4*c* and 4*g*, the bottom portions 522, 524 of each deflector is staggered relative to the honeycomb assembly 204. In the specific example of FIG. 4*g*, the non-variable height diffuser 514 is spaced from the bottom portion 522 of the first deflector 166 and adjacent to the bottom portion 524 of the second deflector 167. As shown in FIGS. 4*i* and 4*j*, the variable-height diffuser 510 is spaced from the bottom portion 524 of the second deflector 167. So configured, the deflectors 166, 167, 168 direct air through channels formed between the first and second deflectors 166, 167 and into the inlets 518, 520 of the diffusers 510, 514. The diffusers 510, 514 shape air flow forcing the air to flow through a plurality of channels 526 of the diffusers 510, 514.

As shown more clearly in FIG. 4*i*, the plurality of channels 526 of the variable-height diffuser 510 have a square or rectangular-shaped opening separated, or defined by, a plurality of walls. As shown in FIG. 4*h*, the plurality of channels 526 are the same or similar in both of the diffusers 510, 514. However, in other examples, the plurality of channels 526 may be circular, octagonal, or other polygonal shape with walls separating each channel of various thicknesses.

In FIG. 4*h*, the variable and non-variable height diffusers 510, 514 are illustrated from an interior-looking-out perspective of the OWC unit 100. Generally speaking, the inlet or top surface 518 of the variable-height diffuser 510 is nonplanar relative to the planar inlet 520 of the non-variable height diffuser 514. However, at the right side of the assembly 204 (i.e., adjacent to the first side wall 116 of the OWC unit 100 in FIG. 4*g*), the variable and non-variable diffusers 510, 514 initially extend along the X-axis at the same height $h_1$ measured in the Z-coordinate axis. In another example, however, the height of the first and second diffusers 510, 514 may never match or align or they may match at the left side (i.e., adjacent the second side wall 118 of the OWC unit 100), or between the right and left ends of the diffuser assembly 204. An outlet 528 or bottom surface of the variable-height diffuser 510 is planar and, in the illustrated example, is co-planar with an outlet 530 (FIG. 4*g*) or bottom surface of the non-variable height diffuser 514. However, in other examples, the outlet 528, 530 of one or more of the diffusers 510, 514 may be non-planar, such as, for example, corrugated and/or staggered. In yet further examples, the variable and non-variable diffusers 510, 514 may be spaced from each other in a Y-coordinate direction (into the page in FIG. 4*h*), or they may be staggered relative to the Z-coordinate axis. The diffusers 510, 514 may be separate components, or the diffusers 510, 514 are fixedly attached to form a unitary component.

By providing a honeycomb diffuser 510 with a plurality of elevations and profiles across the length of the honeycomb (i.e., across the width of the OWC unit 100 and/or between the first and second side walls 116, 118), it is found that the honeycomb diffuser 510 is better able to attenuate the significantly variable air velocities imparted by the fans 142*a*, 142*b*, 142*c*, 142*d*, 142*e* of the evaporator 142 (FIG. 4*g*). High air velocities, on the order of 800 feet per minute, are experienced in the center of the air curtain, but significantly lower air velocities are experienced at the far ends of the air curtains (on the order of only about 100 to about 200 feet per minute). The diffuser assembly 204 is designed to maximize air distribution across the opening 108 of the OWC unit 100 based on the airflow properties within the OWC unit 100. While the variable-height honeycomb diffuser 510 is illustrated (such as in FIGS. 4*h*-4*j*) as having a first region 510*a* of a first height $h_1$, a second region 510*b* of a second height $h_2$ shorter than the first region 510*a*, and a tapering third region 510*c*, it is recognized that the topography of the variable-height honeycomb diffuser 510 is not limited to that shown. Rather, the topography may be selected to provide optimal airflow uniformity within the OWC unit 100 to compensate for fluctuations in evaporator fan output and to achieve a desirable air flow velocity and/or pressure. By improving air velocity through the honeycomb structure of the diffuser 204, it is easier, and more energy efficient, to maintain low air and product temperatures, particularly near the floor.

Figure 5:
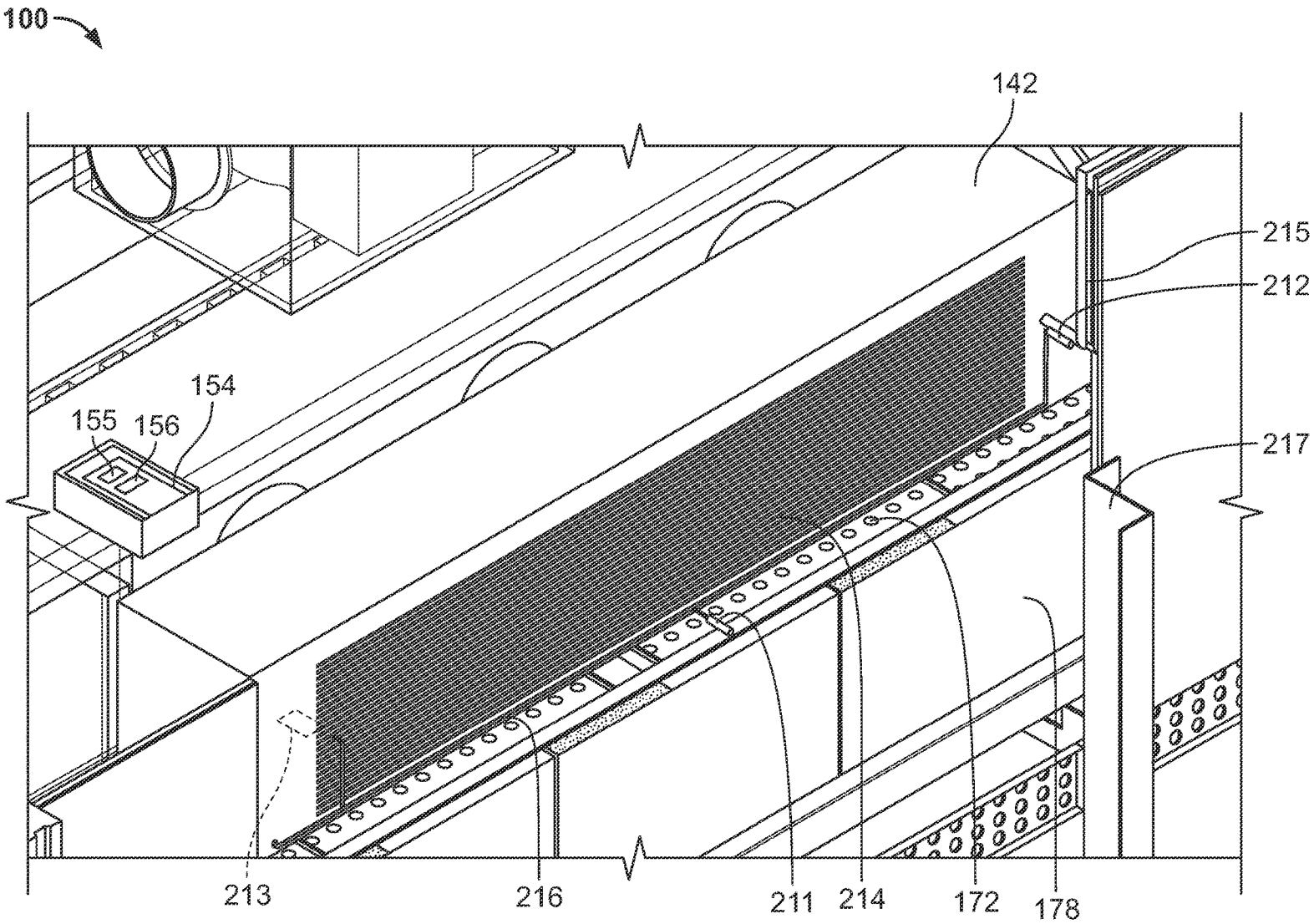
FIG. 5 is a partial, back perspective view of the OWC unit of FIG. 1, illustrating a control system.

In FIGS. 1 and 5, the control system 154 is illustrated in more detail. The control system 154 is disposed on the roof 112 (hidden in FIG. 5) or in the evaporator 142 of the OWC unit 100 and is coupled to control a variety of functions of the air curtain assembly 158 and/or the refrigeration system 134. For example, the control system 154 operates the defrost cycle and includes at least one sensor coupled to the evaporator 142 and configured to capture sensor data associated with a temperature at an input 214 and/or inside the evaporator 142, such as on a coil of the evaporator 142. The control system 154 includes one or more processors 155 and a memory 156 that is communicatively coupled to the one or more processors 155 and stores executable instructions to operate the refrigeration system 134. The executable instructions causes the one or more processors 155 to receive the sensor data captured by the one or more sensors, analyze the sensor data to identify a status or condition associated with the evaporator 142, and send a signal to the evaporator 142 to heat or cool based on the status or condition identified.

In one example shown in FIG. 5, the control system 154 includes a first sensor 211, a second sensor 212, a third sensor 213 and a conduit 216, or temperature wire, connecting the first, second, and third sensors 211, 212, and 213 to the control system 154. The temperature wire 216 runs through the front (i.e., the outlet side) of the evaporator 142 and through the back of the evaporator 142 (i.e., the inlet side). The first sensor 211 is in the return airstream before entering the coil at an input 214 of the evaporator 142, the second sensor 212 is disposed on a suction line 215 connecting the evaporator 142 to the condenser 138, and the third sensor 213 is disposed inside of the evaporator 142 and between the coils (i.e., where the ice clears last) of the evaporator 142. So configured, the three temperature sensors 211, 212, 213 relay information about the temperatures to the control system 154 at various locations on or near the evaporator 142 to accurately determine when and how long the defrost cycle should run and to monitor the evaporator 142 during the defrost and cooling cycles.

Also shown in FIG. 5 is a backer 217 of the OWC unit 100. The backer 217 provides structural support for the OWC unit 100 and helps channel air flow through the back duct 180. The OWC unit 100 may include a plurality of backers 217 spaced apart and along the back wall 104 of the OWC unit 100. The backers 217 may be positioned to channel air flow from the back duct 180 to feed the blower 146 (via the duct 150), as shown in FIG. 2. Together with the back wall 104 and the wall plates 176, 178, the backers 217 may define separate plenums formed in the back duct 180 to distribute air into the input 214 of the evaporator 142. One or more of the backers 217 may be "Z" backers having a Z cross-section. The backers 217 may extend partially or entirely along a height of the OWC unit 100.

Figure 6:
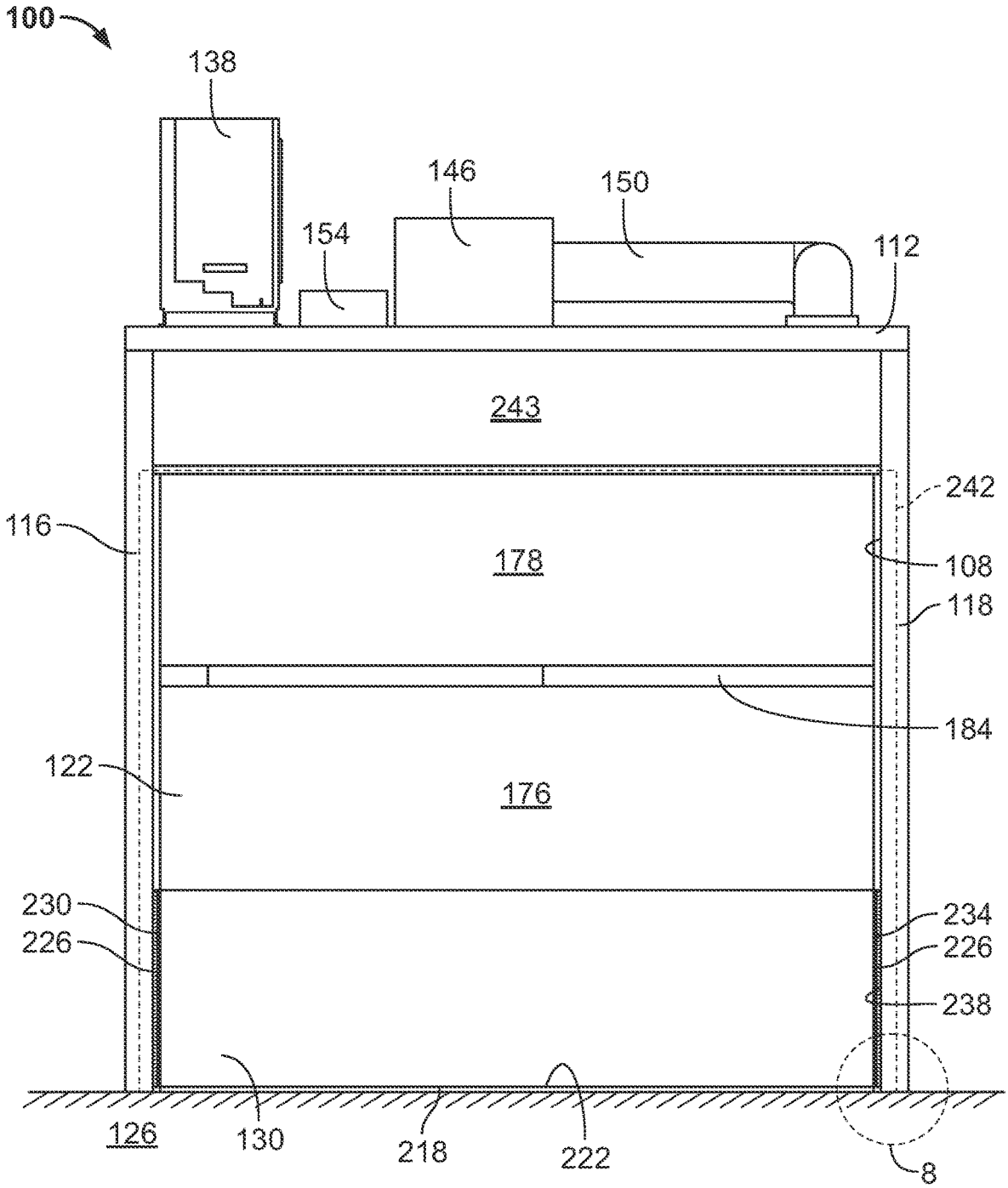
FIG. 6 is a front view of the OWC unit of FIG. 1, illustrating a movable barrier in a closed position.
Figure 8:
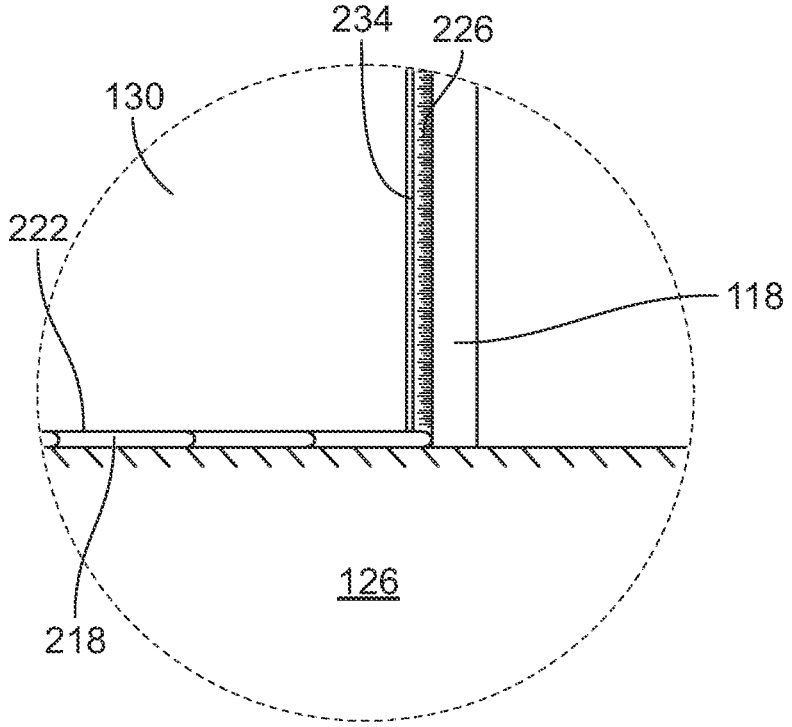
FIG. 8 is magnified view of a sealing arrangement of the movable barrier in the closed position of FIG. 6.
Figure 9:
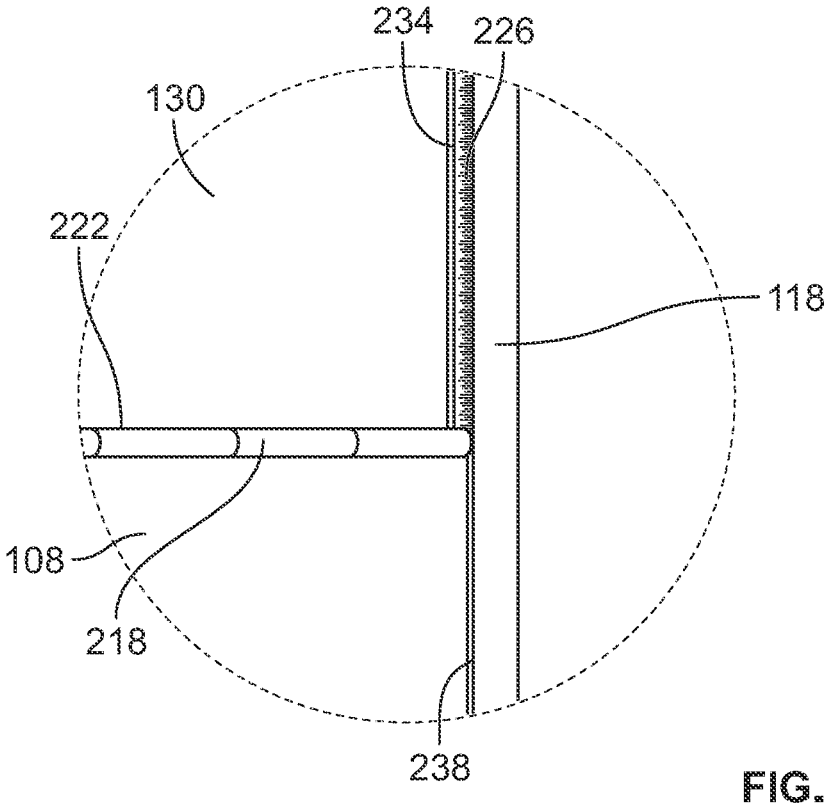
FIG. 9 is a magnified view of the sealing arrangement of the movable barrier in the open position of FIG. 7.

Turning now to FIGS. 6-9, the OWC unit 100 is shown with the barrier 130 in a closed position (FIGS. 6 and 8) and an open position (FIGS. 7 and 9). The barrier 130 is a movable plate that serves to both keep air circulating through the interior space 122 of the OWC unit 100 while also protecting the product stored in the OWC unit 100. In FIG. 6, the barrier 130 sealingly engages the floor 126 to limit heat exchange across the opening 108. As cool air from the air barrier 190 flows toward the ground 126, the barrier 130 keeps the cool air within the interior space 122. With the barrier 130 in the closed position, the opening 108 of the OWC unit 100 is large enough for a customer to comfortably reach into the OWC unit 100 to access the products stored in the interior space 122. In FIG. 8, the barrier 130 is lifted to an open position to permit restocking of the OWC unit 100 with items requiring refrigeration. In particular, the barrier 130 may be lifted to a height that permits a forklift to enter the OWC unit 100 to deliver pallets of items or remove pallets from the OWC unit 100.

A first seal 218 is disposed along a bottom edge 222 of the barrier 130, and a second seal 226 is disposed on first and second side edges 230, 234 of the barrier 130. FIG. 8 illustrates a magnified view of the first and second seals 218, 226 at the bottom edge 222 and second side edge 234 of the barrier 130 when the barrier 130 is in the closed position. The first seal 218 is a durable seal, such as a bulb seal, having a width substantially similar to a width of the barrier 130, and a length extending along the bottom edge 222 of the barrier 130. When the barrier 130 is in the closed position, the seal 218 compresses under the weight of the barrier 130 and seals against the floor 126. When the barrier 130 is in the open position, as shown in FIGS. 7 and 9, the seal 218 is in an uncompressed configuration. The seal 218 is flexible to accommodate any uneven surfaces in the floor 126 and may be configured to create a seal when light debris is disposed on the ground 126 and in the opening 108. The seal 218 is also durable for repeated use in cold temperature environments. The seal 218 may be a bulb seal, a brush seal, or other suitable seal, which may be made of foam, vinyl, and rubber, and either in filled or solid configurations.

The second seal 226 is disposed between each of the first and second side edges 230, 234 of the barrier 130 and the first and second sidewalls 116, 118. The second seals 226 allow movement of the barrier 130 between the open and closed positions, while sufficiently sealing a joint 238 between the first and second sidewalls 116, 118 and the barrier 130, thereby limiting cool air from escaping the OWC unit 100 at the joint 238. The joint 238 (i.e., where the barrier 130 is coupled to the first and second sidewalls 116, 118) may be a sliding rail 226, pulley, or other mechanical device that slidably connects the barrier 130 to the first and second side walls 116, 118. The joint 238 permits an operator or automated pulley or other mechanical system to lift the barrier 130 from the closed position to the open position. The barrier 130 may remain in the open position by engaging a locking mechanism or other device.

Turning back briefly to FIG. 6, an optional heating device 242 is shown in dashed lines. The heating device 242 is embedded in the OWC unit 100 such that the device 242 is disposed along the bottom of an opening header 243 between the first and second sidewalls 116, 118 and a stainless steel jamb guard protecting the outer ends of the first and second sidewalls 116, 118 and the opening header 243. The heating device 242 is configured to elevate the temperature of the surfaces surrounding the opening 108 above a dew point range. The heating device 242 may include a heating wire that extends around the opening 108 of the OWC unit 100, and in particularly, where heat is removed from the surfaces around the opening 108 by the refrigeration system 134. However, in other examples, the heating wire may partially extend around the opening 108, may be placed in targeted areas in segments around the opening 108, may be placed only against the ends of the sidewalls 116, 118, or may be placed only against the door header of the roof panel 112. In one example, the heating device 242 includes a ten watt-per-lineal-foot self-regulating heater, such as a Chromalox® CPR heat trace, and may be controlled by a creep action thermostat, such as a PEPI® creep action thermostat, also embedded behind the stainless steel jamb guard trim of the opening 108. The heater device 242 may be locally or remotely controlled, and may be operated separately from the control system 154 and separately from operating the barrier 130.

Figure 10:
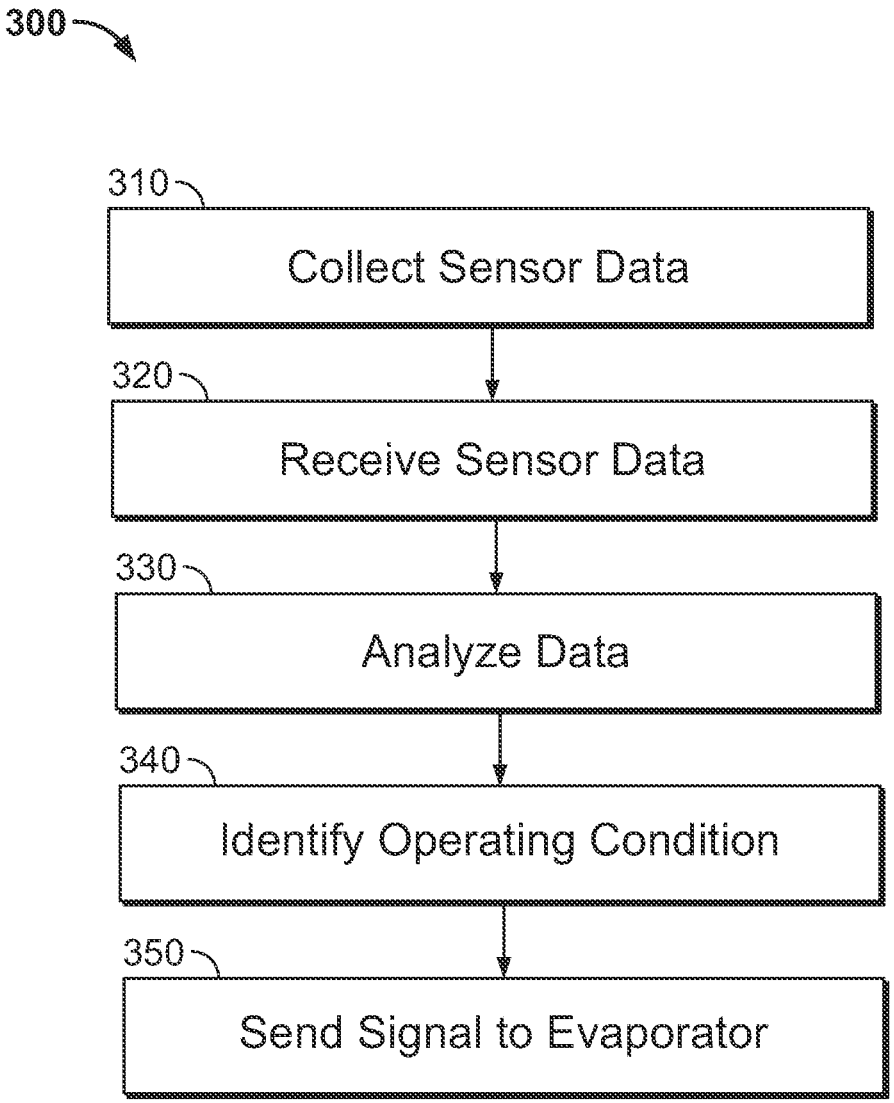
FIG. 10 is a schematic diagram of an exemplary defrost cycle of a control system of the OWC unit of FIG. 1 in accordance with the teachings of the present disclosure.

In FIG. 10, an exemplary flow diagram for operating the control system 154 of an OWC unit 100 is shown. At a first block 310, sensor data is continuously (or periodically) collected by at least one sensor coupled to the evaporator 142. For example, the sensors may collect temperature data at the input 214 and in the coil of the evaporator 142. At a second block 320, one or more processors 155 receive the sensor data captured by the sensors. At a third block 330, the one or more processors 155 analyze the sensor data and compare the sensor data to instructions stored in the memory 156. For example, a temperature captured by the at least one sensor may be compared to a temperature associated with a condition or status of the evaporator 142 that is stored in the memory 156. The temperature captured may be compared to a threshold temperature stored in the memory 156. In another example, the processor 155 measures a difference between the temperature at the input 214 of the evaporator 142 and the coil of the evaporator 142. If the temperature measured or a temperature difference meets or exceeds a stored threshold, a status or condition associated with the evaporator 142 at that threshold temperature is identified and assigned at block 340. Based on that identification, at block 350 the control system 154 sends a signal to the evaporator 142 to initiate defrost.

With respect to a defrost operation, the control system 154 operates according to the flow chart of FIG. 10 to limit ice from forming on the evaporator coil. Ice formation on the evaporator 142 can lower the operating efficiency of the evaporator 142 and may reduce the ability of the evaporator 142 to remove heat from the air. The defrost cycle of the control system 154 of the present disclosure periodically adds heat to the evaporator 142 to de-ice the coil in order to maintain the lowest average temperature possible inside the OWC unit 100. The defrost function is based on the temperature difference between the evaporator coil and the air entering the evaporator 142. The defrost function of the control system 154 measures the temperature difference by monitoring first, second, and third temperature sensors 211, 212, 213. The temperature at various locations near or on the evaporator 142 may be monitored over a period of time. If a temperature difference between the evaporator coil and input 214 exceeds a temperature difference threshold stored in the memory 156, a defrost cycle is initiated by sending a signal to the evaporator 142 to raise the temperature of the coil assembly in the evaporator 142. The defrost function also monitors the coils of the evaporator 142 where ice clears last. Once this temperature reaches a certain threshold, then the defrost cycle may stop as that data indicates that the evaporator 142 is clear of ice. Additionally, the temperature taken at the suction line 215 connecting the evaporator 142 and the condenser 138 may indicate ice forming on the evaporator 142. For example, during normal operation, heat is transferred to the refrigerant and that heat is read by the second temperature sensor 212. If ice develops on the coils of the evaporator 142, the second temperature sensor 212 will not sense any heat getting transferred to the refrigerant as that heat is blocked by the ice buildup. In this case, this temperature sensor 212 helps determine when to initiate the defrost cycle. Other sensor configurations and algorithms to run a defrost cycle are possible. The on-demand defrost cycle reduces the number of daily defrosts typical for a refrigeration system, and thereby saves energy. The defrost cycle also runs on an as-needed basis. The control system 154 may operate other functions including other sensor and sensor data. In other examples, the control system 154 may operate pressure sensors, humidity sensors, and auxiliary temperature sensors.

Figure 11:
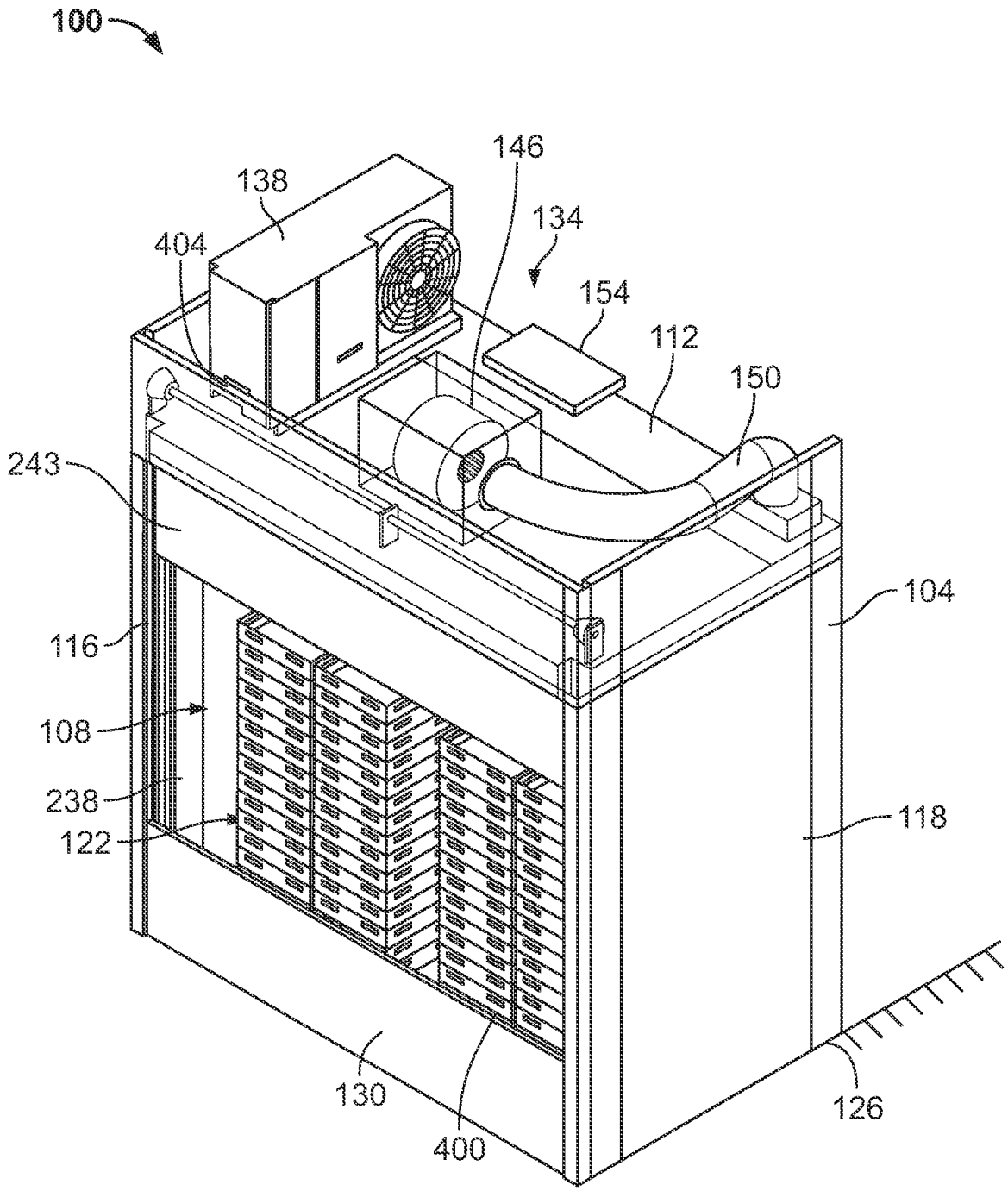
FIG. 11 is a perspective view of the OWC unit of FIG. 1 with plurality of crates.

FIG. 11 illustrates the OWC unit 100 with a plurality of stacked crates or pallets 400 assembled in accordance with the teachings of the present disclosure. In FIG. 11, a façade 404 extends from the roof 112 to hide the refrigeration and control systems 134, 154, and may provide an opportunity for a design or advertisement display.

Figure 12:
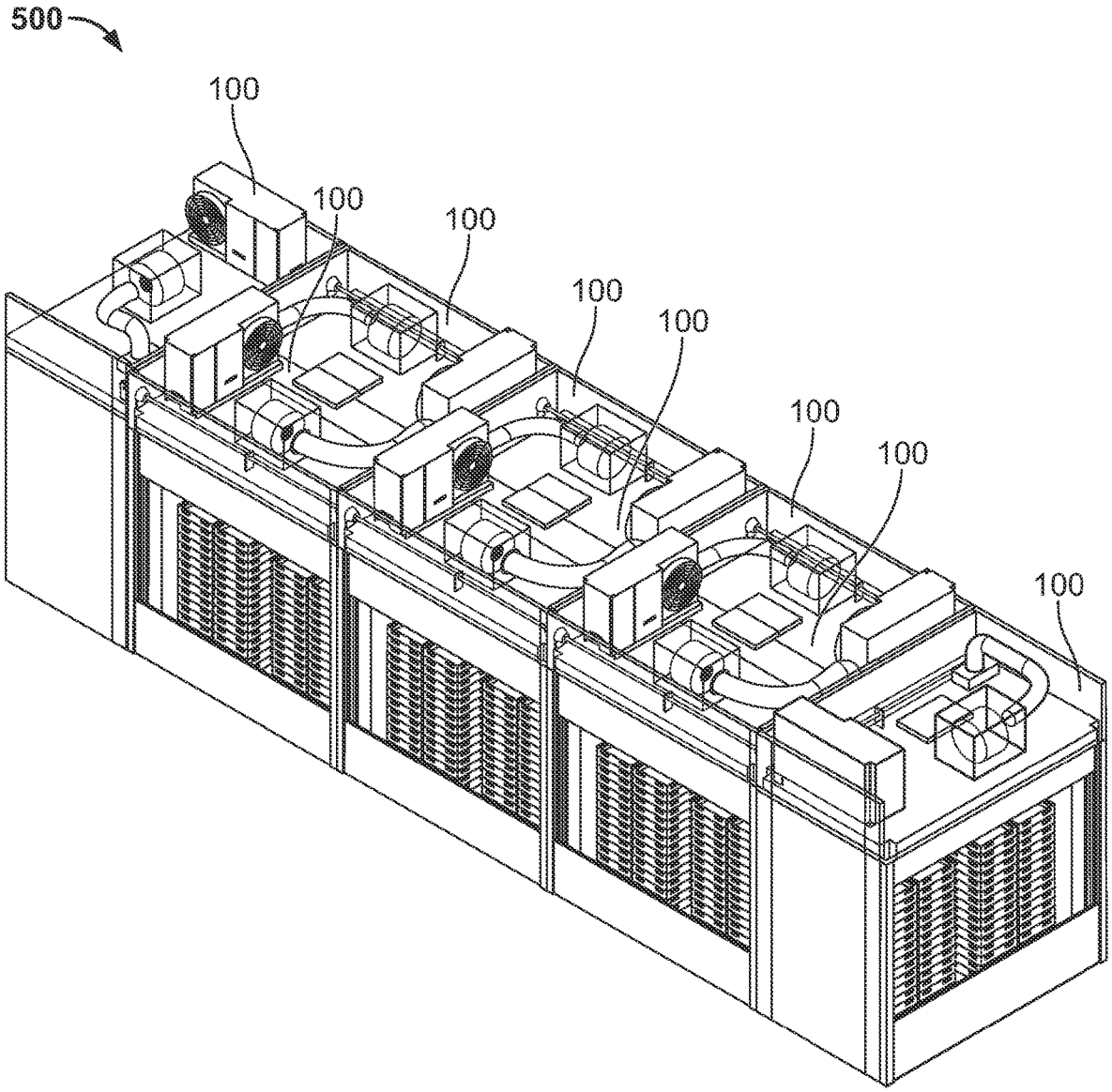
FIG. 12 is a perspective view of an exemplary layout of multiple OWC units assembled in accordance with the teachings of the present disclosure.

FIG. 12 illustrates an exemplary OWC unit layout 500 including a plurality of OWC units 100 assembled in accordance with the teachings of the present disclosure. As shown in FIG. 12, a plurality of OWC units 100 are assembled in two parallel rows in a back-to-back configuration (i.e., with the back wall 104 of an OWC unit 100 adjacent to or abutting against a back wall 104 of another OWC unit 100) with an OWC unit 100 located at each end of the rows. However, other layouts and orientations are possible.

The OWC unit 100 of the present disclosure provides an energy-efficient solution for storing and cooling products. Firstly, the air curtain design and barrier 130 of the OWC unit 100 work together to limit heat exchange across the opening 108, thereby requiring less energy to maintain cooler temperatures. The circulation provided by the air curtain assembly also more evenly distributes the cool air within the interior 122 of the OWC unit 100. As a result, the product may be continuously surrounded by refrigerated air, and, in the case of produce, may be evenly chilled and therefore less susceptible to localized damage due to frost. For example, the air curtains 192, 194, 196 of the present disclosure are channeled and deflected to flow into different sections or spaces of the interior space 122 of the OWC unit 100. For example, the first air curtain 192 flows underneath a product closer to the ground 127, the second curtain 194 flows into a middle section of a stored product, and the third air curtain 196 flows across a top portion of the product.

Secondly, the refrigeration system 134 and control system 154 also help reduce energy consumption and keep costs low to run an OWC unit. The control system 154 may be programmed to run an on-demand defrost cycle to run the evaporator 142 more efficiently which consequently extends the operating life of the refrigeration system 134. In addition to the energy efficiency, the refrigeration system 134 required for each OWC unit 100 is relatively small in comparison to existing cooling solutions. For example, each unit includes a small condenser 138, which reduces noise and occupies less space.

The OWC unit 100 of the present disclosure also provides an accessible and low maintenance refrigeration storage solution. The movable barrier 130 facilitates stocking and restocking with product and permits easy clean-up by simply moving the barrier 130 to an open position. In an open position, an operator may access the crates of products with a forklift and easily clean the ground surrounding the crates. The interior space 122 is simple, allowing for simply stacking crates of produce for customer access. In other examples, the OWC unit 100 may include shelving, either built-in or provided on rollers, to store and showcase the product. When the barrier 130 is in the closed position, the opening 108 enables a customer to comfortably reach into the interior 122 of the OWC unit 100 to grab a product stored within the OWC unit 100. This solution provides a more comfortable shopping experience as the customer does not need to entirely enter a refrigerated room to access the product.

The OWC unit 100 is also easy to assembly and may be scaled up or scaled down to meet a customer's needs. For example, a supermarket owner is not limited to a single location for installing the OWC unit 100. Because of the small footprint and modular construction, the OWC unit 100 may be relocated to another location fairy easily. Additionally, the OWC unit 100 may be remotely managed to operate a number of functions, for example, moving the barrier 130, monitoring the refrigeration system 134, and operating the control system 154.

Preferred embodiments of this invention are described herein, including the best mode or modes known to the inventors for carrying out the invention. Although numerous examples are shown and described herein, those of skill in the art will readily understand that details of the various embodiments need not be mutually exclusive. Instead, those of skill in the art upon reading the teachings herein should be able to combine one or more features of one embodiment with one or more features of the remaining embodiments. Further, it also should be understood that the illustrated embodiments are exemplary only, and should not be taken as limiting the scope of the invention. All methods described herein can be performed in any suitable order unless otherwise indicated herein or otherwise clearly contradicted by context. The use of any and all examples, or exemplary language (e.g., "such as") provided herein, is intended merely to better illuminate the aspects of the exemplary embodiment or embodiments of the invention, and do not pose a limitation on the scope of the invention. No language in the specification should be construed as indicating any non-claimed element as essential to the practice of the invention.

What is claimed:

1. An accessible cooling environment comprising:

a back wall, an opening opposite the back wall, a roof, first and second side walls at least partially defining the opening, and an interior space at least partially defined by the back wall, roof, and first and second side walls;

a barrier disposed in the opening and extending between the first and second side walls, the barrier slidably movable between a closed position, in which the barrier sealingly engages a floor along a first seal, the first seal having a width substantially similar to a width of the barrier and a length extending along a bottom edge of the barrier, and sealingly engages the first and second side walls along respective second seals, one along a first side edge of the barrier and another along a second side edge of the barrier and the barrier being slidably connected to the first and second sidewalls, and an open position, in which the barrier is spaced upwardly away from the floor;

an evaporator disposed in the interior space and having an input and a coil;

a control system connected to the evaporator, the control system comprising:

at least one sensor coupled to the evaporator and configured to capture sensor data associated with a temperature of at least one of the input and the coil of the evaporator;

one or more processors;

a memory communicatively coupled to the one or more processors and storing executable instructions that, when executed by the one or more processors, causes the one or more processors to:

receive the sensor data captured by the at least one sensor;

analyze the sensor data to identify a status or condition associated with the evaporator; and send a signal to the evaporator to heat or cool based on the status or condition identified.

2. The accessible cooling environment of claim 1, further comprising an air curtain assembly including a fan and one or more deflectors, the fan and the one or more deflectors configured to form an air barrier and channel the air barrier adjacent the opening, the air barrier including a first air curtain at a first temperature and a second air curtain at a second temperature lower than the first temperature.

3. The accessible cooling environment of claim 2, wherein the one or more deflectors of the air curtain assembly is disposed between the opening and the fan to separate the first and second air curtains.

4. The accessible cooling environment of claim 2, wherein the air barrier includes a third air curtain having a temperature lower than the temperature of the second air curtain.

5. The accessible cooling environment of claim 4, wherein the temperature of the first air curtain is in a range of 40 degrees Fahrenheit to 50 degrees Fahrenheit, the temperature of the second air curtain is in a range of 33 degrees Fahrenheit to 40 degrees Fahrenheit, and the temperature of the third air curtain is in a range of 25 degrees Fahrenheit to 35 degrees Fahrenheit.

6. The accessible cooling environment of claim 2, further comprising a diffuser having a variable height and disposed closer to a front of the opening than the one or more deflectors, the diffuser and including a plurality of channels forming a honeycomb structure.

7. The accessible cooling environment of claim 6, wherein a height of the diffuser varies across a length extending between the first and second side walls.

8. The accessible cooling environment of claim 6, further comprising a second diffuser adjacent to the diffuser.

9. The accessible cooling environment of claim 1, wherein the at least one sensor includes a first sensor disposed at the input of the evaporator and a second sensor disposed inside the evaporator.

10. The accessible cooling environment of claim 7, wherein the one or more processors is configured to compare sensor data of the at least one sensor, and to send a signal to the evaporator to raise the temperature of the evaporator to initiate a defrost cycle.

11. The accessible cooling environment of claim 1, further comprising a seal disposed between the barrier and the floor when the barrier is in the closed position.

12. The accessible cooling environment of claim 1, further comprising a shelf disposed in the interior space and a curved air deflector adjacent to an exterior edge of the shelf.

13. The accessible cooling environment of claim 12, further comprising a light coupled to the shelf and disposed adjacent to an interior surface of the curved air deflector.

14. An accessible cooling environment comprising:

a back wall, an opening opposite the back wall, a roof panel, first and second side walls at least partially defining the opening, and an interior space at least partially defined by the back wall, roof panel, and first and second side walls;

at least one fan configured to circulate air through the interior space;

an evaporator disposed inside the interior space;

an air curtain assembly configured to form an air barrier adjacent to the opening, the air curtain assembly including one or more deflectors for separating the air barrier into a first air curtain and a second air curtain;

a barrier disposed in the opening and extending between the first and second side walls, the barrier slidably movable between a closed position, in which the barrier sealingly engages a floor along a first seal, the first seal having a width substantially similar to a width of the barrier and a length extending along a bottom edge of the barrier, and sealingly engages the first and second side walls along respective second seals, one along a first side edge of the barrier and another along a second side edge of the barrier and the barrier being slidably connected to the first and second sidewalls, and an open position, in which the barrier is spaced upwardly away from the floor; and a diffuser having a plurality of channels and a variable height as the diffuser extends between the first and second side walls.

15. The accessible cooling environment of claim 14, wherein the first air curtain has a first temperature and the second air curtain has a temperature lower than the first temperature.

16. The accessible cooling environment of claim 14, wherein the air barrier includes a third air curtain having a temperature lower than the temperature of the second air curtain.

17. The accessible cooling environment of claim 16, wherein the third air curtain is disposed adjacent to the interior space, the first air curtain is disposed adjacent to the opening, and the second air curtain is disposed between the first air curtain and the third air curtain.

18. The accessible cooling environment of claim 14, further comprising a shelf disposed in the interior space and a curved air deflector adjacent to an exterior edge of the shelf.

19. The accessible cooling environment of claim 18, further comprising a light coupled to the shelf and disposed adjacent to an interior surface of the curved air deflector.

20. The accessible cooling environment of claim 14, further comprising a defrost system connected to the evaporator, the defrost system comprising:

at least one sensor coupled to the evaporator and configured to capture sensor data associated with a temperature of at least one of an input and a coil of the evaporator;

one or more processors;

a memory communicatively coupled to the one or more processors and storing executable instructions that, when executed by the one or more processors, causes the one or more processors to:

receive sensor data captured by the at least one sensor;

analyze the sensor data to identify a status or condition associated with the evaporator; and send a signal to the evaporator to heat or cool based on the status or condition identified.

21. The accessible cooling environment of claim 20, wherein the at least one sensor includes a first sensor disposed at the input of the evaporator and a second sensor disposed inside of the evaporator.

22. The accessible cooling environment of claim 20, wherein the one or more processors is configured to compare sensor data of the at least one sensor, and to send a signal to the evaporator to raise the temperature of the evaporator to initiate a defrost cycle.

23. The accessible cooling environment of claim 3, wherein the fan includes a blower at least partially disposed outside of the interior space.

24. The accessible cooling environment of claim 23, wherein the fan includes multiple fans of the evaporator.

25. The accessible cooling environment of claim 2, wherein the air curtain assembly includes a blower and at least one fan of the evaporator.

* * * * *